US008980517B2

(12) United States Patent
Kawaguchi et al.

(10) Patent No.: US 8,980,517 B2
(45) Date of Patent: Mar. 17, 2015

(54) TONER

(71) Applicant: Canon Kabushiki Kaisha, Tokyo (JP)

(72) Inventors: Shintaro Kawaguchi, Yokohama (JP); Katsuyuki Nonaka, Mishima (JP); Koji Abe, Numazu (JP); Naoya Isono, Suntou-gun (JP); Yuhei Terui, Numazu (JP); Taiji Katsura, Suntou-gun (JP); Akira Sugiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/141,241

(22) Filed: Dec. 26, 2013

(65) Prior Publication Data

US 2014/0186760 A1 Jul. 3, 2014

(30) Foreign Application Priority Data

Dec. 28, 2012 (JP) ..... 2012-288237

(51) Int. Cl.

| | |
|---|---|
| ***G03G 9/093*** | (2006.01) |
| ***G03G 9/097*** | (2006.01) |
| ***G03G 9/08*** | (2006.01) |
| ***G03G 9/087*** | (2006.01) |

(52) U.S. Cl.

CPC ..... *G03G 9/09775* (2013.01); *G03G 9/0825* (2013.01); *G03G 9/0827* (2013.01); *G03G 9/08773* (2013.01); *G03G 9/09328* (2013.01)

USPC ..... 430/110.2; 430/110.1

(58) Field of Classification Search

USPC ..... 430/110.1, 110.2

See application file for complete search history.

(56) References Cited

U.S. PATENT DOCUMENTS

| | | | | |
|---|---|---|---|---|
| 6,358,658 | B1 * | 3/2002 | Tazawa et al. | 430/110.1 |
| 2006/0292477 | A1 | 12/2006 | Daimon et al. | |
| 2010/0075245 | A1 | 3/2010 | Watanabe et al. | |

FOREIGN PATENT DOCUMENTS

| | | | |
|---|---|---|---|
| EP | 1003080 | A1 | 5/2000 |
| JP | S57-124740 | A | 8/1982 |
| JP | 03-089361 | A | 4/1991 |
| JP | 08-095284 | A | 4/1996 |
| JP | 2001-75304 | A | 3/2001 |
| JP | 2004-053916 | A | 2/2004 |
| JP | 2006-146056 | A | 6/2006 |

OTHER PUBLICATIONS

U.S. Appl. No. 14/141,260, filed Dec. 26, 2013, Koji Abe.

* cited by examiner

*Primary Examiner* — Hoa V Le

(74) *Attorney, Agent, or Firm* — Canon USA, Inc. IP Division

(57) ABSTRACT

A toner having good development durability, storage stability, environmental stability, and low-temperature fixability is provided. The toner contains toner particles each including a surface layer that contains an organic silicon polymer. The organic silicon polymer contains a unit having a specific structure. The average thickness Dav. of the surface layers is a specific value and the silicon concentration determined by ESCA is 2.5% or more. The toner has a shape factor SF-2 of 140 or more and 260 or less and an average circularity of 0.970 or more and 0.990 or less.

7 Claims, 3 Drawing Sheets

TONER

BACKGROUND OF THE INVENTION

1. Field of the Invention

The present invention relates to a toner for developing electrostatic latent images used in image forming methods such as electrophotographic methods and electrostatic printing methods.

2. Description of the Related Art

As computers and multimedia become more advanced, there arises an increasing need to develop ways to output high-definition full color images that satisfy various needs in homes and offices.

In offices where large quantities of copies and printouts are made, image forming apparatuses desirably have high durability whereby degradation of image quality is suppressed even when a large number of copies and printouts are made. In contrast, in small offices and homes, image forming apparatuses are desirably capable of producing high-quality images and are desirably small to save space and energy and reduce weight. To satisfy these needs, toners used therein desirably have improved properties, such as environmental stability, low-temperature fixability, development durability, long-term storage stability, and cleaning performance and a lower tendency to soil parts of apparatuses (hereinafter this tendency is referred to as "non-soiling property").

In particular, a full color image is formed by superimposing color toners. Unless all of the color toners are developed equally, the color reproducibility is degraded and color nonuniformity is generated. If a pigment or a dye used as a colorant of a toner is precipitated on the surfaces of toner particles, the developing performance is affected and color nonuniformity may result.

In forming a full color image, fixability and color mixing property during fixing are important. For example, in order to achieve high-speed image formation, a binder resin suitable for low temperature fixing is selected. The influence of this binder resin on the developing performance and durability is also large.

Moreover, devices, mechanisms, etc., configured to output high-definition full color images and withstand long-term use in various environments that involve wide ranges of temperature and humidity are also in demand. In order to meet such a need, several challenges are desirably addressed, such as suppressing changes in the toner surface properties and changes in the charge amount of toners caused by changes in the operation environment and minimizing soiling of parts such as a developing roller, a charging roller, a regulating blade, and a photosensitive drum. In this respect, development of a toner that exhibits stable chargeability despite being stored in a wide variety of environments for a long time and has stable development durability that does not cause soiling of parts has been eagerly anticipated.

One of the causes of changes in charge amount and storage stability of the toner due to temperature and humidity is a phenomenon called bleeding in which a release agent and a resin component in the toner ooze out from the interior of the toner particle to the surface of the toner particle, thereby altering the surface properties of the toner.

One way to address this challenge is to cover the surface of a toner particle with a resin.

Japanese Patent Laid-Open No. 2006-146056 discloses a toner that has good high-temperature storage stability and exhibits good printing durability when printing is conducted in a normal temperature, normal humidity environment or a high temperature, high humidity environment. This toner includes inorganic fine particles strongly fixed to toner particle surfaces. However, even if inorganic fine particles are strongly fixed to toner particles, bleeding of a release agent and a resin component occurs through gaps between the inorganic fine particles and the inorganic fine particles may detach due to deterioration of durability. Accordingly, the durability in a severe environment is desirably further improved and the problem of soiling of parts is desirably addressed.

Japanese Patent Laid-Open No. 03-089361 discloses a method for producing a polymerized toner, in which a silane coupling agent is added to the reaction system to try to prevent colorants and polar substances from becoming exposed in the toner particle surfaces and to obtain a toner that has a narrow charge amount distribution and very low dependence of charge amount on humidity. However, according to this method, the amount of precipitates of the silane compounds on the toner particle surfaces and hydrolytic polycondensation are insufficient. The environmental stability and the development durability are desirably further improved.

Japanese Patent Laid-Open No. 08-095284 discloses a way of controlling the charge amount of the toner and forming high-quality printed images irrespective of temperature and humidity in the environment. In particular, it discloses a polymerized toner in which a silane is used to coat surfaces of toner particles. However, the polarity of organic functional groups is high and hydrolytic polycondensation and the amount of precipitates of the silane compound on the toner particle surfaces are insufficient. Further improvements are desired in order to enhance the storage stability, suppress soling of parts by toner fusion, and decrease the change in image density caused by changes in chargeability at high temperature and high humidity.

Japanese Patent Laid-Open No. 2001-75304 discloses a toner that improves fluidity, low temperature fixability, and blocking property and suppresses detachment of a fluidizer. This toner is a polymerized toner that includes a coating layer in which granular lumps containing a silicon compound are fixed to each other. However, bleeding of a release agent and a resin component occurs through gaps between the granular lumps containing a silicon compound. The image density changes due to changes in chargeability in a high temperature, high humidity environment due to insufficient hydrolytic polycondensation and an insufficient amount of silane compound precipitates on the toner particle surfaces. Moreover, parts become soiled by toner fusion. These problems are desirably addressed and the storage stability is desirably further improved.

SUMMARY OF THE INVENTION

The present invention provides a toner that addresses the challenges described above. In particular, the present invention provides a toner that has good environmental stability, low-temperature fixability, development durability, and storage stability.

The inventors of the present invention have conducted extensive studies and made the present invention based on the findings.

The present invention provides a toner including toner particles each including a surface layer that contains an organic silicon polymer.

The organic silicon polymer includes a unit represented by formula (1) or (2) below:

(1)

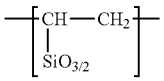

(2)

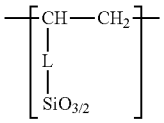

(In formula (2), L represents a methylene group, an ethylene group, or a phenylene group).

An average thickness Dav. of the surface layers measured by observation of cross sections of the toner particles with a transmission electron microscope (TEM) is 5.0 nm or more and 150.0 nm or less.

A silicon concentration determined by electron spectroscopy for chemical analysis (ESCA) performed on surfaces of the toner particles is 2.5 atomic % or more.

The toner has a shape factor SF-2 of 140 or more and 260 or less.

The toner has an average circularity of 0.970 or more and 0.990 or less.

Further features of the present invention will become apparent from the following description of exemplary embodiments with reference to the attached drawings.

DESCRIPTION OF THE EMBODIMENTS

Figure 1:
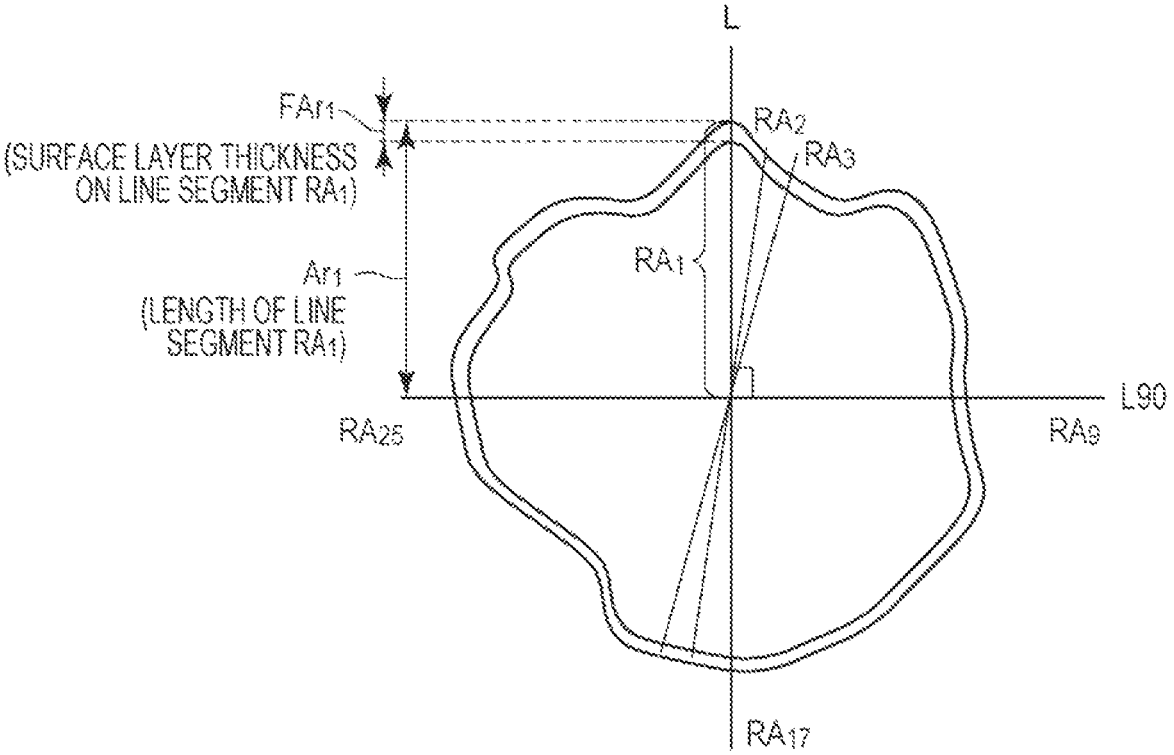
FIG. 1 is a diagram showing an example of a cross-sectional image of a toner particle observed with TEM.

The present invention will now be described in detail.

A toner according to an embodiment of the present invention contains toner particles each including a surface layer that contains an organic silicon polymer.

The organic silicon polymer contains a unit represented by formula (1) or (2) below:

(1)

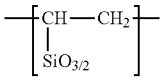

(2)

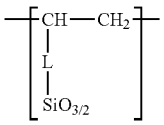

(In formula (2), L represents a methylene group, an ethylene group, or a phenylene group.)

An average thickness Dav. of the surface layers measured by observation of cross sections of toner particles with a transmission electron microscope (TEM) is 5.0 nm or more and 150.0 nm or less.

A silicon concentration relative to the toner determined by electron spectroscopy for chemical analysis (ESCA) of surfaces of the toner particles is 2.5 atomic % or more.

The toner has a shape factor SF-2 of 140 or more and 260 or less.

The toner has an average circularity of 0.970 or more and 0.990 or less.

Organic Silicon Polymer

Since toner particles have surface layers that contain an organic silicon polymer having a unit represented by formula (1) or (2) above, the hydrophobicity of the surfaces of the toner particles can be improved and a toner with good environmental stability can be obtained. In the unit represented by formula (1) or (2) above, the bonding energy between an organic structure and a silicon atom is strong. Thus, toner particles that have surface layers containing such an organic silicon polymer can exhibit good development durability.

The organic silicon polymer that includes a unit represented by formula (1) or (2) above may be a polymer represented by formula (5) or (6) below:

(5)

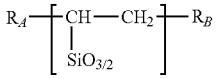

(6)

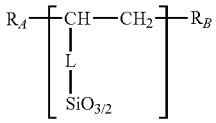

(In formulae (5) and (6), L represents a methylene group, an ethylene group, or a phenylene group and $R_A$ and $R_B$ each independently represent a unit represented by formula (7) or (8) below:

(7)

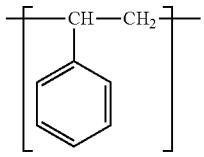

(8)

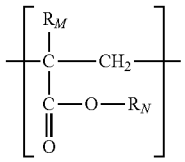

(In formula (8), $R_N$ represents a hydrogen atom or an alkyl group having 1 to 22 carbon atoms and $R_M$ represents a hydrogen atom or a methyl group.))

The organic silicon polymer represented by formula (5) or (6) above helps further improve environmental stability and low-temperature fixability.

$R_M$ in formula (8) represents a hydrogen atom or a methyl group that improve environmental stability. $R_N$ in formula (8) represents a hydrogen atom or an alkyl group having 1 to 22 carbon atoms that improve the low temperature fixability and development durability.

Silicon Concentration at Surfaces of Toner Particles

A silicon concentration dSi of the toner at the surfaces of the toner particles is preferably 2.5 atomic % or higher, more preferably 5.0 atomic % or higher, and most preferably 10.0 atomic % or higher relative to the total of the silicon concentration dSi, the oxygen concentration dO, and the carbon concentration dC (dSi+dO+dC) determined by electron spectroscopy for chemical analysis (ESCA) performed on the surfaces of the toner particles. ESCA is an element analysis technique of the outermost surface several nanometers in depth. When the silicon concentration in the outermost surface layers of the toner particles is 2.5 atomic % or higher, the surface free energy of the outermost surface layers can be lowered. The fluidity can be further improved and the soiling of parts and fogging can be further suppressed by adjusting the silicon concentration to 2.5 atomic % or higher.

The silicon concentration of the outermost surface layers of the toner particles can be controlled by adjusting the ratio of the hydrophilic groups to the hydrophobic groups in the organic silicon polymer, reaction temperature, reaction time, reaction solvent, pH, and the content of the organic silicon polymer. For the purposes of the present invention, the "outermost surface layer" refers to a portion that extends from the surface of a toner particle (depth: 0.0 nm) to a depth of 10.0 nm toward the center of the toner particle (midpoint of the long axis).

Shape Factor SF-2 of Toner

A toner having a shape factor SF-2 in the range of 140 to 260 has irregularities on the toner surfaces and a toner having high cleaning performance can be obtained. The SF-2 value is more preferably 180 or more. The SF-2 value can be controlled by adjusting the organic silicon polymer content.

Average Circularity of Toner

With a toner having an average circularity in the range of 0.970 to 0.990, changes in image density are decreased when a large number or printouts are made. The average circularity is more preferably 0.980 or more. When the average circularity of the toner is within the aforementioned range, the image density after making a large number of printouts can be improved.

Average thickness Dav. of surface layers of toner particles, number of non-adjacent line segments having lengths equal to or smaller than RAav×0.90, and percentage of the surface layer thicknesses that are 5.0 nm or less out of surface layer thicknesses $FRA_n$ The average thickness Dav. of the surface layers of the toner particles containing the organic silicon polymer and determined by cross-sectional observation of toner particles with a transmission electron microscope (TEM) is desirably 5.0 nm or more and 150.0 nm or less. At this average thickness, bleeding of the release agent and the resin components can be suppressed and a toner having good storage stability, environmental stability, and development durability can be obtained. From the viewpoint of storage stability, the average thickness Dav. of the surface layers of the toner particles is more preferably 10.0 nm or more and 150.0 nm or less and yet more preferably 10.0 nm or more and 125.0 nm or less, and most preferably 15.0 nm or more and 100.0 nm or less.

The average thickness Dav. of the surface layers of the toner particles containing the organic silicon polymer can be controlled by adjusting the ratio of the hydrophilic groups to the hydrophobic groups in the organic silicon polymer, the reaction temperature, reaction time, reaction solvent, and pH for addition polymerization and condensation polymerization, and the content of the organic silicon polymer.

In order to increase the average thickness Dav. (nm) of the surface layers of the toner particles, the proportion of the hydrophobic groups in the organic silicon polymer may be decreased.

In a cross section of a toner particle observed with a transmission electron microscope (TEM), sixteen straight lines that pass through the midpoint of a long axis L, which is a maximum diameter of the cross section, and extend across the cross section are drawn such that the intersectional angles between adjacent straight lines at the midpoint are equal to each other (namely, 11.25°) with reference to the long axis L and that thirty-two line segments $RA_n$ (n=1 to 32) that extend from the midpoint to the surface of the toner particle are formed (refer to FIG. 1). Assuming the length of each line segment to be $Ar_n$ (n=1 to 32) and the average of the lengths $Ar_n$ to be RAav, two or more non-adjacent line segments that have lengths $Ar_n$ equal to or smaller than RAav×0.90 are desirably present. In this manner, the toner particle comes to have two or more recessed portions and exhibits high cleaning performance. This value can be controlled by adjusting the organic silicon polymer content.

In a cross section of a toner particle observed with a transmission electron microscope (TEM), sixteen straight lines that pass through the midpoint of a long axis L, which is a maximum diameter of the cross section, and extend across the cross section are drawn such that the intersectional angles at the midpoint are equal to each other (namely, 11.25°) with reference to the long axis L and that thirty-two line segments $RA_n$ (n=1 to 32) that extend from the midpoint to the surface of the toner particle are formed (refer to FIG. 1). Assuming the length of each line segment to be $Ar_n$ (n=1 to 32) and the thickness of the surface layer that lies on the line segment $RA_n$ to be $FAr_n$ (n=1 to 32), the percentage (existing ratio) of the surface layer thicknesses that are 5.0 nm or less out of the surface layer thicknesses $FAr_n$ may be 20.0% or less. Such a toner exhibits good image density stability and suppresses fogging in a wide variety of environments.

The average thickness Dav. of the surface layers of the toner particles and the percentage (existing ratio) of the surface layer thicknesses that are 5.0 nm or less can be controlled by adjusting the reaction temperature, the reaction time, the reaction solvent, the pH value, and the organic silicon polymer content.

Method for Preparing Organic Silicon Polymer

A representative example of a method for preparing an organic silicon polymer according to an embodiment of the invention is a sol-gel method. In a sol-gel method, a metal alkoxide $M(OR)_n$ (M: metal, O: oxygen, R: hydrocarbon, n: oxidation number of metal) is used as a starting material, is hydrolyzed and condensation polymerized in a solvent to form a sol, and is formed into a gel. A sol-gel method is used to synthesize glass, ceramics, organic-inorganic hybrid materials, and nano-composites. According to this method, functional materials of various forms, such as fibers, bulks and fine particles, can be synthesized from a liquid phase at a low temperature.

In particular, surface layers of the toner particles are formed by hydrolytic polycondensation of a silicon compound such as alkoxysilane. When a surface layer is uniformly provided on the surface of each toner particle, the environmental stability is improved without fixing or adhering inorganic fine particles as in the toners of the related art. Moreover, the performance of the toner is rarely degraded in long-term use and a toner having good storage stability can be obtained.

In a sol-gel method, a solution is used in the initial stage and this solution is gelled to form a material. Thus, various fine structures and shapes can be fabricated. In particular, for toner particles formed in an aqueous medium, it is easy to provide an organic silicon compound on surfaces of toner particles due to the hydrophilicity exhibited by hydrophilic groups such as silanol groups in the organic silicon compound. However, if the hydrophobicity of the organic silicon compound is high (for example, when the organic silicon compound contains functional groups that are highly hydrophobic), it becomes difficult to precipitate the organic silicon compound at the surface layers of the toner particles. Accordingly, it becomes difficult to form a toner particle that has a surface layer containing the organic silicon polymer. In contrast, if the hydrophobicity of the organic silicon compound is low, the charge stability of the toner tends to be degraded. The fine structures and shapes of the toner particles can be controlled by adjusting the reaction temperature, reaction time, reaction solvent, pH, the type of the organic silicon compound, and the amount of the organic silicon compound added, for example.

The organic silicon polymer may be obtained by polymerizing a polymerizable monomer containing a compound represented by formula (Z) below:

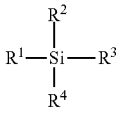

(Z)

(In formula (Z), $R^1$ represents (i) $CH_2{=}CH{-}$ or (ii) $CH_2{=}CH\text{-}L\text{-}$ (in formula (ii), L represents a methylene group, an ethylene group, or a phenylene group.) and $R^2$, $R^3$, and $R^4$ each independently represent a halogen atom, a hydroxy group, or an alkoxy group.)

When toner particles contain, in their surface layers, an organic silicon polymer obtained by polymerizing a polymerizable monomer containing a compound represented by formula (Z) above, the hydrophobicity of the surfaces of the toner particles can be improved. As a result, the environmental stability of the toner can be further improved. To facilitate incorporation of the organic silicon polymer in the surface layers, the number of carbon atoms in $R^1$ is preferably 5 or less, more preferably 3 or less, and most preferably 2 or less. From the viewpoints of the coatability of the surface layers of the toner particles and the chargeability and durability of the toner, $R^1$ preferably represents a vinyl group or an allyl group and more preferably represents a vinyl group.

$R^2$, $R^3$, and $R^4$ each independently represent a halogen atom, a hydroxy group, or an alkoxy group (hereinafter may also be referred to as "reactive group"). These reactive groups undergo hydrolysis, addition polymerization, or condensation polymerization to form a crosslinked structure. Since such a crosslinked structure is formed on the surfaces of toner particles, a toner having good development durability can be obtained. In particular $R^2$, $R^3$, and $R^4$ preferably each independently represent an alkoxy group and more preferably each independently represent a methoxy group or an ethoxy group since hydrolysis proceeds slowly at room temperature, the organic silicon polymer can be smoothly precipitated at the surfaces of the toner particles, and the coatability on the surfaces of the toner particles is improved. Hydrolysis, addition polymerization, or condensation polymerization of $R^2$, $R^3$, and $R^4$ can be controlled by adjusting the reaction temperature, reaction time, reaction solvent, and pH.

Examples of the organic silicon compound represented by formula (Z) above (hereinafter may be referred to as "trifunctional silane") include trifunctional vinylsilanes such as vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, and vinyldiethoxyhydroxysilane; and trifunctional allylsilanes such as allyltrimethoxysilane, allyltriethoxysilane, allyldiethoxymethoxysilane, allylethoxydimethoxysilane, allyltrichlorosilane, allylmethoxydichlorosilane, allylethoxydichlorosilane, allyldimethoxychlorosilane, allylmethoxyethoxychlorosilane, allyldiethoxychlorosilane, allyltriacetoxysilane, allyldiacetoxymethoxysilane, allyldiacetoxyethoxysilane, allylacetoxydimethoxysilane, allylacetoxymethoxyethoxysilane, allylacetoxydiethoxysilane, allyltrihydroxysilane, allylmethoxydihydroxysilane, allylethoxydihydroxysilane, allyldimethoxyhydroxysilane, allylethoxymethoxyhydroxysilane, and allyldiethoxyhydroxysilane.

These organic silicon compounds may be used alone or in combination.

The content of the organic silicon compound represented by formula (Z) is preferably 50 mol % or more and more preferably 60 mol % or more in the organic silicon polymer. The environmental stability of the toner can be further improved when the content of the organic silicon compound represented by formula (Z) is 50 mol % or more.

An organic silicon polymer obtained by using an organic silicon compound having three functional group per molecule (trifunctional silane), an organic silicon compound having two functional groups per molecule (difunctional silane), or an organic silicon compound having one reactive group per molecule (monofunctional silane) in combination with the organic silicon compound represented by formula (Z) may also be used.

Examples of the organic silicon compound that can be used in combination with the organic silicon compound represented by formula (Z) include dimethyldiethoxysilane, tetraethoxysilane, hexamethyldisilazane, 3-glycidoxypropyltrimethoxysilane, 3-glycidoxypropylmethyldiethoxysilane, 3-glycidoxypropyltriethoxysilane, p-styryltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, 3-(2-aminoethyl)aminopropyltrimethoxysilane, 3-(2-aminoethyl) aminopropyltriethoxysilane, 3-phenylaminopropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, 3-glycidoxypropyltrimethoxysilane, 3-glycidoxypropylmethyldimethoxysilane, 3-glycidoxypropylmethyldiethoxysilane, hexamethyldisilane, tetraisocyanatesilane, methyl triisocyanatesilane, and vinyl triisocyanatesilane.

It is generally known that, in a sol-gel reaction, the bonding state of the siloxane bonds generated differs depending on the acidity of the reaction medium. To be more specific, when the reaction medium is acidic, a hydrogen ion is electrophilically added to an oxygen atom of one functional group (for example, an alkoxy group (—OR group)). Then oxygen atoms in the water molecules coordinate to a silicon atom, thereby forming a hydrosilyl group by substitution reaction. If there is enough water present, one $H^+$ attacks one oxygen atom of a reactive group (for example, an alkoxy group (—OR group)) and thus the speed of substitution reaction to hydroxy groups is low if the $H^+$ content in the reaction medium is low. As a result, polycondensation reaction occurs before all of the reactive groups attached to the silane are hydrolyzed and one-dimensional linear polymers and two-dimensional polymers are relatively easily generated.

In contrast, when the reaction medium is alkaline, hydroxide ions are added to the silicon atom and a 5-coordinated intermediate is produced during the course of the reaction. Accordingly, all of the reactive groups (for example, alkoxy groups (—OR groups)) can easily be eliminated and easily substituted into silanol groups. In particular, when a silicon compound having three or more reactive groups is used for the same silane, hydrolysis and polycondensation occurs three dimensionally and an organic silicon polymer having many three-dimensional crosslinks is formed. Moreover, the reaction ends in a short time.

In view of the above, an organic silicon polymer is preferably prepared by a sol-gel reaction in an alkaline reaction medium. In order to form the polymer in an aqueous medium, the pH may be 8.0 or more. In this manner, an organic silicon polymer that has a higher strength and higher durability can be formed. The sol-gel reaction may be performed for 5 hours or longer at a reaction temperature of 90° C. or higher. When a sol-gel reaction is performed at this reaction temperature for this reaction time, formation of coalesced particles in which silane compounds in a sol state or a gel state on the surfaces of the toner particles are bonded to each other can be suppressed.

The organic silicon compound may be used in combination with an organic titanium compound or an organic aluminum compound.

Examples of the organic titanium compound include o-allyloxy(polyethylene oxide)triisopropoxytitanate, titanium allylacetoacetate triisopropoxide, titanium bis(triethanolamine)diisopropoxide, titanium tetra-n-butoxide, titanium tetra-n-propoxide, titanium chloride triisopropoxide, titanium chloride triisopropoxide, titanium di-n-butoxide(bis-2,4-pentanedionate), titanium chloride diethoxide, titanium diisopropoxide(bis-2,4-pentanedionate), titanium diisopropoxide bis(tetramethylheptanedionate), titanium diisopropoxide bis(ethyl acetoacetate), titanium tetraethoxide, titanium 2-ethylhexyloxide, titanium tetraisobutoxide, titanium tetraisopropoxide, titanium lactate, titanium methacrylate isopropoxide, titanium methacryloxyethyl acetoacetate triisopropoxide, (2-methacryloxyethoxy)triisopropoxy titanate, titanium tetramethoxide, titanium methoxypropoxide, titanium methylphenoxide, titanium n-nonyloxide, titanium oxide bis(pentanedionate), titanium n-propoxide, titanium stearyloxide, titanium tetrakis(bis-2,2-(allyloxymethyl)butoxide), titanium triisostearoylisopropoxide, titanium methacrylate methoxyethoxide, tetrakis(trimethylsiloxy)titanium, titanium tris(dodecylbenzenesulfonate) isopropoxide, and titanocene diphenoxide.

Examples of the organic aluminum compound include aluminum(III) n-butoxide, aluminum(III) s-butoxide, aluminum (III) s-butoxide bis(ethyl acetoacetate), aluminum(III) t-butoxide, aluminum(III) di-s-butoxide ethyl acetoacetate, aluminum(III) diisopropoxide ethyl acetoacetate, aluminum (III) ethoxide, aluminum(III) ethoxyethoxyethoxide, aluminum hexafluoropentanedioanate, aluminum(III) 3-hydroxy-2-methyl-4-pyronate, aluminum(III) isopropoxide, aluminum-9-octadecenyl acetoacetate diisopropoxide, aluminum(III) 2,4-pentanedionate, aluminum phenoxide, and aluminum(III) 2,2,6,6-tetramethyl-3,5-heptanedionate.

These organic titanium compounds and organic aluminum compounds may be used alone or in combination. The amount of charges can be controlled by appropriately selecting a combination of these compounds and adjusting the amount added.

The organic silicon polymer may be obtained by polymerizing the vinyl-based polymerizable monomer and the compound represented by formula (Z) above.

Method for Producing Toner Particles

A method for producing toner particles will now be described.

The description below provides specific embodiments of having an organic silicon polymer incorporated in surface layers of toner particles. However, the present invention is not limited to these embodiments.

A first production method includes forming particles in an aqueous medium from a polymerizable monomer composition containing a polymerizable monomer, a colorant, and an organic silicon compound and polymerizing the polymerizable monomer to obtain toner particles (hereinafter this method may also be referred to as a "suspension polymerization method").

During the course of polymerization of the polymerizable monomer in the first production method, the halogen atoms, hydroxy groups, or alkoxy groups in $R^2$, $R^3$, $R^4$ are desorbed and the volume of the toner particle is decreased. However, since the organic silicon compound that undergoes little changes in volume is uniformly precipitated on the surfaces of the toner particles, the toner particles come to have recesses due to the decrease in volume as these groups are removed from the system by distillation. This enhances cleaning performance.

A second production method includes preparing toner base bodies first, placing the toner base bodies in an aqueous medium, and forming surface layers of an organic silicon polymer on the toner base bodies in the aqueous medium. The toner base bodies may be obtained by melt kneading a binder resin and a colorant and pulverizing the resulting product. Alternatively, the toner base bodies may be obtained by agglomerating and associating the binder resin particles and the colorant particles in an aqueous medium, or by suspending in an aqueous medium an organic phase dispersion, which is prepared by dissolving a binder resin, a silane compound, and a colorant in an organic solvent, so as to form particles and conduct polymerization and then removing the organic solvent.

A third production method includes suspending in an aqueous medium an organic phase dispersion, which is prepared by dissolving a binder resin, a silane compound, and a colorant in an organic solvent, so as to form particles and conduct polymerization, and then removing the organic solvent to obtain toner particles. A fourth production method includes agglomerating and associating binder resin particles, colorant particles, and organic silicon compound-containing particles in a sol or gel state in an aqueous medium to form toner particles.

A fifth production method includes spraying a solvent containing an organic silicon compound onto surfaces of toner base bodies by a spray drying method and polymerizing or drying the surfaces by blowing hot air or by cooling so as to form surface layers containing the organic silicon compound. The toner base bodies may be obtained by melt kneading a binder resin and a colorant and pulverizing the resulting product, or by agglomerating and associating binder resin particles and colorant particles in an aqueous medium, or by suspending in an aqueous medium an organic phase dispersion, which is prepared by dissolving a binder resin, a silane compound, and a colorant in an organic solvent, so as to form particles and conduct polymerization and then removing the organic solvent.

Toner particles produced by these production methods include surface layers that contain an organic silicon polymer and thus exhibit good environmental stability (in particular, the chargeability in a severe environment). Moreover, changes in the surface state of the toner particles caused by bleeding of the release agent and the resin in the toner interior are suppressed even in a severe environment.

The toner particles obtained by these production methods may be surface-treated by applying hot air. When toner particles are surface-treated by applying hot air, condensation polymerization of the organic silicon polymer near the surfaces of the toner particles is accelerated and the environmental stability and the development durability can be improved.

A technique capable of treating surfaces of toner particles or a toner with hot air and cooling the treated toner particles by using cool air may be employed as the surface treatment that uses hot air described above. Examples of the machines used to conduct a surface treatment using hot air include Hybridization System (produced by Nara Machinery Co., Ltd.), Mechanofusion System (produced by Hosokawa Micron Corporation), Faculty (produced by Hosokawa Micron Corporation), and Meteorainbow MR type (produced by Nippon Pneumatic MFG., Co., Ltd.).

Examples of the aqueous medium used in the production methods described above include water, alcohols such as methanol, ethanol, and propanol, and mixed solvents of these.

Among the production methods described above, the first production method (suspension polymerization method) may be employed to produce toner particles. According to the suspension polymerization method, it is easy to have an organic silicon polymer uniformly precipitated in surfaces of the toner particles, good adhesion is achieved between the surface layers and the interiors of the toner particles, and the storage stability, the environmental stability, and the development durability are enhanced. The suspension polymerization method is described in further detail below.

If needed, a release agent, a polar resin, and a low-molecular-weight resin may be added to the polymerizable monomer composition described above. Upon completion of the polymerization step, the particles generated may be washed and recovered by filtration, and dried to obtain toner particles. Heating may be conducted in the latter half of the polymerization step. In order to remove unreacted polymerizable monomer and by-products, part of the dispersion medium may be distilled away from the reaction system in the latter half of the polymerization step or after completion of the polymerization step.

Low-Molecular-Weight Resin

The following resins can be used as the low-molecular-weight resin as long as the effects of the invention are not impaired: homopolymers of styrene or its substitutes such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleic acid ester copolymer; and polymethyl methacrylate, polybutyl methacrylate, polyvinyl acetate, polyethylene polypropylene, polyvinyl butyral, silicone resin, polyester resin, polyamide resin, epoxy resin, polyacrylic resin, rosin, modified rosin, terpene resin, phenolic resin, aliphatic or alicyclic hydrocarbon resin, and aromatic petroleum resin.

These resins may be used alone or in combination.

In order to address changes in viscosity of the toner at high temperature, the resin may contain a polymerizable functional group. Examples of the polymerizable functional group include a vinyl group, an isocyanate group, an epoxy group, an amino group, a carboxylic acid group, and a hydroxy group.

The weight-average molecular weight (Mw) of the THF soluble of the low-molecular-weight resin determined by GPC may be 2000 to 6000.

Polar Resin

The polar resin may be a saturated or unsaturated polyester-based resin.

Examples of the polyester-based resin include those obtained by condensation polymerization of an acid component monomer and an alcohol component monomer. Examples of the acid component monomer include terephthalic acid, isophthalic acid, phthalic acid, cyclohexanedicarboxylic acid, and trimellitic acid.

Examples of the alcohol component monomer include bisphenol A, hydrogenated bisphenol, ethylene oxide adducts of bisphenol A, propylene oxide adducts of bisphenol A, glycerin, trimethylol propane, and pentaerythritol.

Release Agent

Examples of the release agent include petroleum-based wax and derivatives thereof such as paraffin wax, microcrystalline wax, and petrolatum, montan wax and derivatives thereof, Fisher-Tropsch hydrocarbon wax and derivatives thereof, polyolefin wax and derivatives thereof such as polyethylene and polypropylene, natural wax and derivatives thereof such as carnauba wax and candelilla wax, higher aliphatic alcohols, fatty acids and compounds thereof such as stearic acid and palmitic acid, acid amide wax, ester wax, ketone, hydrogenated castor oil and derivatives thereof, vegetable wax, animal wax, and silicone.

The derivatives also refer to oxides, block copolymers with vinyl-based monomers, and graft modified products.

Polymerizable Monomer

The following vinyl-based polymerizable monomers can be used in addition to the compound represented by formula (Z) above as the polymerizable monomer used in the suspension polymerization method: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acryl-based polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; methacryl-based polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; esters of methylene aliphatic monocarboxylic acids; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; and vinyl methyl ketone, vinyl hexyl ketone, and vinyl isopropyl ketone.

Among these vinyl-based polymers, styrene-based polymers, styrene-acryl-based copolymers, and styrene-methacryl-based copolymers are preferable. The adhesion with the organic silicon polymer is improved and the storage stability and the development durability are enhanced.

Other Additives

In polymerizing the polymerizable monomer, a polymerization initiator may be added.

Examples of the polymerization initiator include azo- or diazo-based polymerization initiators such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile; and peroxide-based polymerization initiators such as benzoyl peroxide, methyl ethyl ketone peroxide, diisopropyloxy carbonate, cumene hydroperoxide, 2,4-dichlorobenzoyl peroxide, and lauroyl peroxide.

The amount of the polymerization initiator added may be 0.5 to 30.0 mass % relative to the polymerizable monomer. Two or more polymerization initiators may be used in combination.

In order to control the molecular weight of the binder resin contained in the toner particles, a chain transfer agent may be added in polymerizing the polymerizable monomer. The amount of the chain transfer agent may be 0.001 to 15.000 mass % relative to the polymerizable monomer.

In order to control the molecular weight of the binder resin contained in the toner particles, a crosslinking agent may be added in polymerizing the polymerizable monomer.

Examples of the crosslinking agent include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, #200, #400, and #600 diacrylates of polyethylene glycol, dipropylene glycol diacrylate, polypropylene glycol diacrylate, polyester-type diacrylate (MANDA produced by Nippon Kayaku Co., Ltd.), and methacrylates of the foregoing.

Examples of a polyfunctional crosslinking agent include pentaerythritol triacrylate, trimethylol ethane triacrylate, trimethylol propane triacrylate, tetramethylol methane tetraacrylate, oligo ester acrylate and methacrylate, 2,2-bis(4-methacryloxy.polyethoxyphenyl)propane, diacryl phthalate, triallyl cyanurate, triallyl isocyanurate, triallyl trimellitate, and diallyl chlorendate.

The amount of the crosslinking agent added may be 0.001 to 15.000 mass % relative to the polymerizable monomer.

Binder Resin

The binder resin contained in the toner particles is preferably a vinyl-based resin and more preferably a styrene-based resin, a styrene-acryl-based resin, or a styrene-methacryl-based resin. A vinyl-based resin is synthesized as a result of polymerization of the vinyl-based polymerizable monomer described above. Vinyl-based resins have excellent environmental stability. Vinyl-based resins are also advantageous since they give highly uniform surfaces and cause an organic silicon polymer obtained by polymerization of a polymerizable monomer containing a compound represented by formula (Z) to precipitate in the surfaces of the toner particles.

Dispersion Stabilizer

In the case where the medium used in polymerizing the polymerizable monomer is an aqueous medium, the following can be used as the dispersion stabilizer for particles of the polymerizable monomer composition: hydroxyapatite, tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer include polyvinyl alcohol, gelatin, methyl cellulose, methyl hydroxypropyl cellulose, ethyl cellulose, carboxymethyl cellulose sodium salt, and starch.

Commercially available nonionic, anionic, and cationic surfactants can also be used.

Examples of the surfactant include sodium dodecyl sulfate, sodium tetradecyl sulfate, sodium pentadecyl sulfate, sodium octyl sulfate, sodium oleate, sodium laurate, and potassium stearate.

In the case where a slightly water-soluble inorganic dispersion stabilizer is used to prepare an aqueous medium, the amount of the dispersion stabilizer added may be 0.2 to 2.0 parts by mass per 100.0 parts by mass of the polymerizable monomer. The aqueous medium may be prepared by using 300.0 to 3,000.0 parts by mass of water per 100.0 parts by mass of the polymerizable monomer composition.

A commercially available dispersion stabilizer can be directly used in preparing an aqueous medium in which the slightly water-soluble inorganic dispersion stabilizer is dispersed. In order to obtain a dispersion stabilizer having fine and uniform particle size, a slightly water-soluble inorganic dispersion stabilizer may be generated in a liquid medium such as water under stirring at high speed. In particular, in the case where tricalcium phosphate is used as the dispersion stabilizer, an aqueous solution of sodium phosphate and an aqueous solution of calcium chloride may be mixed under stirring at high speed so as to form fine particles of tricalcium phosphate and to obtain a desirable dispersion stabilizer.

Colorant

Examples of the colorant used in the toner are as follows.

Examples of the yellow pigment include iron oxide yellow, Naples Yellow, Naphthol Yellow S, Hansa yellow G, Hansa Yellow 10G, Benzidine Yellow G, Benzidine Yellow GR, Lake Quinoline Yellow, Permanent Yellow NCG, Lake Tartrazine, azo compounds, isoindolinone compounds, anthraquinone compounds, azo metal complexes, methine compounds, and allylamide compounds.

Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 109, C.I. Pigment Yellow 110, C.I. Pigment Yellow 111, C.I. Pigment Yellow 128, C.I. Pigment Yellow 129, C.I. Pigment Yellow 147, C.I. Pigment Yellow 155, C.I. Pigment Yellow 168, and C.I. Pigment Yellow 180.

Examples of an orange pigment includes Permanent Orange GTR, Pyrazolone Orange, Vulcan Orange, Benzidine Orange G, Indanthrene Brilliant Orange RK, and Indanthrene Brilliant Orange GK.

Examples of a red pigment include red iron oxide, Permanent Red 4R, Lithol Red, Pyrazolone Red, Watching Red Calcium Salt, Lake Red C, Lake Red D, Brilliant Carmine 6B, Brilliant Carmine 3B, Eosine Lake, Rhodamine B Lake, Alizarin Lake, condensed azo compounds, diketopyrrolopyrrole compounds, anthraquinone, quinacridone compounds, basic dye lake compounds, naphthol compounds, benzimidazolone compounds, thioindigo compounds, and perylene compounds.

Specific examples thereof include C.I. Pigment Red 2, C.I. Pigment Red 3, C.I. Pigment Red 5, C.I. Pigment Red 6, C.I. Pigment Red 7, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of a blue pigment include Alkali Blue Lake, Victoria Blue Lake, Phthalocyanine Blue, Metal-free Phthalocyanine Blue, Phthalocyanine Blue partial chlorides, Fast Sky Blue, Indanthrene Blue BG, and other copper phthalocyanine compounds and derivatives thereof, anthraquinone compounds, and basic dye lake compounds.

Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of a purple pigment include Fast Violet B and Methyl Violet Lake.

Examples of a green pigment include Pigment Green B, Malachite Green Lake, and Final Yellow Green G. Examples of a white pigment include zinc oxide, titanium oxide, antimony white, and zinc sulfide.

Examples of a black pigment include carbon black, aniline black, nonmagnetic ferrite, magnetite, and those pigments adjusted to have a black color by using the yellow colorants, the red colorants, and the blue colorants described above. These colorants can be used alone, in combination as a mixture, or in a solid solution form.

Care should be paid to the polymerization inhibiting effect of the colorant and the colorant's tendency to make transition into a dispersion medium depending on the toner production method. If needed, the colorant may be surface treated with a substance that does not inhibit polymerization so as to modify the surface. In particular, many dyes and carbon black exhibit polymerization inhibiting effects and care should be taken in using these.

An example of a method suitable for treating a dye include polymerizing a Polymerizable monomer in the presence of a dye in advance, and adding a polymerizable monomer composition to the resulting colored polymer. In the case where carbon black is used, the carbon black can be treated in the same way as the dye or can be treated with a substance (for example, organosiloxanes) that reacts with surface functional groups of the carbon black.

The colorant content may be 3.0 to 15.0 parts by mass per 100.0 parts by mass of the binder resin or the polymerizable monomer.

Charge Control Agent

The toner may contain a charge control agent. The charge control agent may be any available charge control agent. In particular, a charge control agent that exhibits a high charging speed and can stably maintain a particular amount of charges may be used. In the case where toner particles are produced by a direct polymerization method, a charge control agent that has a low polymerization inhibition effect and is substantially free of substances soluble in the aqueous medium may be used.

Examples of the charge control agent capable of forming negative charge toners include organic metal compounds and chelating compounds such as monoazo metal compounds, acetylacetone metal compounds, and metal compounds based on aromatic oxycarboxylic acids, aromatic dicarboxylic acids, oxycarboxylic acids, and dicarboxylic acids. Other examples include aromatic oxycarboxylic acids, aromatic mono- and poly-carboxylic acids and metal salts thereof, anhydrides, esters, and phenol derivatives such as bisphenol. Yet other examples include urea derivatives, metal-containing salicylic acid-based compounds, metal-containing naphthoic acid-based compounds, boron compounds, quaternary ammonium salts, and calixarene.

Examples of the charge control agent capable of forming positive charge toners include nigrosin and modified nigrosin such as fatty acid metal salts; guanidine compounds; imidazole compounds; quaternary ammonium salts, onium salts thereof such as phosphonium salts which are analogs of these, and lake pigments thereof such as tributylbenzyl ammonium-1-hydroxy-4-naphthosulfonic acid salt and tetrabutyl ammonium tetrafluoroborate; triphenyl methane dyes and lake pigments thereof (examples of the laking agent include phosphotungstic acid, phosphomolybdic acid, phosphotungstomolybdic acid, tannic acid, lauric acid, gallic acid, ferricyanide, and ferrocyanide); metal salts of higher aliphatic acids; and resin-based charge control agents.

These charge control agents may be used alone or in combination.

Among these charge control agents, metal-containing salicylic acid-based compounds are preferable and more preferably the metal is aluminum or zircon. Of these, 3,5-di-tert-butyl salicylic acid aluminum compound is most preferable.

The charge control resin may be a polymer having a sulfonic acid-based functional group. A polymer having a sulfonic acid-based functional group refers to a polymer or copolymer that has a sulfonic acid group, a sulfonic acid base, or a sulfonic acid ester group.

Examples of the polymer or copolymer that has a sulfonic acid group, a sulfonic acid base, or a sulfonic acid ester group include polymer-type compounds having sulfonic acid groups in the side chains. From the viewpoint of improving the charge stability at high humidity, a polymer-type compound which is a styrene and/or styrene (meth)acrylic acid ester copolymer that has a glass transition temperature (Tg) of 40° C. to 90° C. and contains 2 mass % or more and preferably 5 mass % or more of a sulfonic acid group-containing (meth) acrylamide-based monomer in terms of a copolymerization ratio may be used. With this compound, the charge stability at high humidity is improved.

The sulfonic acid group-containing (meth)acrylamide-based monomer may be one represented by general formula (X) below. Examples thereof include 2-acrylamide-2-methyl propanoic acid and 2-methacrylamide-2-methyl propanoic acid.

(X)

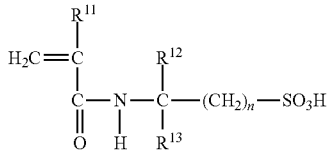

(In formula (X), $R^{11}$ represents a hydrogen atom or a methyl group, $R^{12}$ and $R^{13}$ each independently represents a hydrogen atom or an alkyl group, alkenyl group, aryl group, or alkoxy group having 1 to 10 carbon atoms, and n represents an integer in the range of 1 to 10.)

The polymer having a sulfonic acid group may be contained in an amount of 0.1 to 10 parts by mass per 100 parts by mass of the binder resin in the toner particles so that the charge state of the toner can be further improved when used in combination with a water-soluble initiator. The amount of the charge control agent added may be 0.01 to 10.00 parts by mass per 100.0 parts by mass of the binder resin or the polymerizable monomer.

Organic Fine Particles and Inorganic Fine Particles

Various types of organic fine particles and inorganic fine particles may be externally added to the toner particles so as to impart various properties to the toner. The organic fine particles and the inorganic fine particles may have a particle size equal to or smaller than 1/10 of the weight-average particle size of the toner particles considering the durability of these particles added to the toner particles.

Examples of the organic fine particles and inorganic fine particles are as follows:

(1) Fluidity imparting agent: silica, alumina, titanium oxide, carbon black, and fluorinated carbon;

(2) Abrasives: metal oxides such as strontium titanate, cerium oxide, alumina, magnesium oxide, and chromium oxide; nitrides such as silicon nitride; carbide such as silicon carbide; and metal salts such as calcium sulfate, barium sulfate, and calcium carbonate;

(3) Lubricant: fluorine-based resin powders such as vinylidene fluoride and polytetrafluoroethylene and aliphatic acid metal salts such as zinc stearate and calcium stearate; and (4) Charge control particles: metal oxides such as tin oxide, titanium oxide, zinc oxide, silica, and alumina, and carbon black.

The organic fine particles or inorganic fine particles are used as the material for treating the surfaces of the toner particles in order to improve the fluidity of the toner and make the charges of the toner particles uniform. Since the chargeability of the toner can be controlled and the charge properties in a high humidity environment can be improved by hydrophobing the organic fine particles or the inorganic fine particles, hydrophobized organic or inorganic fine particles may be used. If organic fine particles or inorganic fine particles added to the toner absorb humidity, the chargeability of the toner is degraded and the developing performance and the transfer property tend to be lowered.

Examples of the treating agent used for hydrophobing the organic fine particles or inorganic fine particles include unmodified silicone varnishes, various modified silicone varnishes, unmodified silicone oils, various modified silicone oils, silane compounds, silane coupling agents, other silicon compounds, and organic titanium compounds. These treating agents may be used alone or in combination.

In particular, inorganic fine particles treated with a silicone oil are preferably used. More preferably, inorganic fine particles are hydrophobized with a coupling agent and, at the same time or after this treatment, treated with a silicone oil. Hydrophobized inorganic fine particles treated with a silicone oil help maintain the charge amount of the toner high even in a high humidity environment and reduce the selective developing performance.

The amount of the organic fine particles or the inorganic fine particles added is preferably 0.01 to 10.00 parts by mass, more preferably 0.02 to 1.00 parts by mass, and most preferably 0.03 to 1.00 parts by mass per 100.00 parts by mass of the toner particles. At this amount, penetration of organic fine particles or inorganic fine particles into interior of the toner particles is suppressed and non-soiling property is enhanced. The organic fine particles or the inorganic fine particles may be used alone of in combination.

The BET specific surface area of the organic fine particles or the inorganic fine particles may be 10 $m^2/g$ or more and 450 $m^2/g$ or less.

The BET specific surface area of the organic fine particles or the inorganic fine particles can be determined in accordance with a BET method (preferably a BET multipoint method) through a dynamic flow method and a low-temperature gas adsorption method. For example, a specific surface area meter "GEMINI 2375 Ver. 5.0" (product of Shimadzu Corporation) is used to allow nitrogen gas to adsorb onto surfaces of samples and conduct measurement by a BET multipoint method so as to calculate the BET specific surface area ($m^2/g$).

The organic fine particles or the inorganic fine particles may be strongly fixed or attached to the surfaces of the toner particles. This can be achieved by using a Henschel mixer, Mechanofusion, Cyclomix, Turbulizer, Flexomix, Hybridization, Mechanohydbrid, or Nobilta, for example.

The organic fine particles or the inorganic fine particles can be strongly fixed or attached to the surfaces of the toner particles by increasing the rotation peripheral speed or extending the treatment time.

Physical Properties of Toner

The physical properties of the toner will now be described.

80° C. Viscosity

The 80° C. viscosity of the toner measured with a constant-pressure extrusion system capillary rheometer may be 1,000 Pa·s or more and 40,000 Pa·s or less. When the 80° C. viscosity is within the range of 1,000 to 40,000 Pa·s, the toner exhibits good low-temperature fixability. The 80° C. viscosity is more preferably in the range of 2,000 Pa·s to 20,000 Pa·s. The 80° C. viscosity can be controlled by adjusting the amount of the low-molecular-weight resin added, the type of monomer used for producing the binder resin, the amount of the initiator, the reaction temperature, and the reaction time.

The 80° C. viscosity of the toner measured with the constant-pressure extrusion system capillary rheometer can be determined through the following procedure.

Flow Tester CFT-500D (produced by Shimadzu Corporation) is used as a measurement instrument, for example, and measurement is conducted under the following conditions.

Sample: About 1.0 g of the toner is weighed and pressure-compacted at a load of 100 $kg/cm^2$ for 1 minute to prepare a sample.

Die bore size: 1.0 mm

Die length: 1.0 mm

Cylinder pressure: $9.807\times10^5$ (Pa)

Measurement mode: ascending temperature method

Temperature ascending rate: 4.0° C./min

The viscosity (Pa·s) of the toner in the temperature range of 30° C. to 200° C. is measured by the above-described procedure and the 80° C. viscosity (Pa·s) is determined. The resulting value is assumed to be the 80° C. viscosity measured with a constant-pressure extrusion system capillary rheometer.

Weight-Average Particle Size (D4)

The weight-average particle size (D4) of the toner is preferably 4.0 to 9.0 μm, more preferably 5.0 to 8.0 μm, and most preferably 5.0 to 7.0 μm.

Glass Transition Temperature (Tg)

The glass transition temperature (Tg) of the toner is preferably 35° C. to 100° C., more preferably 35° C. to 80° C., and most preferably 45° C. to 70° C. When the glass transition temperature is within this range, blocking resistance, low-temperature offset resistance, and the transmission property of the projection images on the films for overhead projectors can be further improved.

THF Insoluble Content

The content of substances insoluble in tetrahydrofuran (THF) (hereinafter referred to as THF insoluble content) is preferably less than 50.0 mass %, more preferably 0.0 mass % or more and less than 45.0 mass %, and most preferably 5.0 mass % or more and less than 40.0 mass % relative to the toner components in the toner other than the colorant and the inorganic fine particles. When the THF insoluble content is less than 50.0 mass %, the low-temperature fixability can be improved.

The THF insoluble content of the toner refers to the mass ratio of the ultra high molecular weight polymer (substantially a crosslinked polymer) which became insoluble in the THF solvent. For the purposes of the present invention, the THF insoluble content is the value measured by the following procedure.

One gram of the toner is weighed (W1 g), placed in a cylindrical filter (for example, No. 86R produced by Toyo Roshi Kaisha, Ltd.), and loaded in a Soxhlet extractor. Extraction is conducted for 20 hours by using 200 mL of THF as a solvent and the soluble components extracted with the solvent are condensed and vacuum dried for several hours at 40° C. Then the THF soluble resin components are weighed (W2 g). The weight of components, such as a pigment, other than the resin components in the toner is assumed to be W3 g. The THF insoluble content can be determined from the following equation:

$$\text{THF insoluble content (mass \%)}=\{(W1-(W3+W2))/(W1-W3)\}\times 100$$

The THF insoluble content of the toner can be controlled by adjusting the degree of polymerization and degree of crosslinking of the binder resin.

Weight-Average Molecular Weight (Mw) and Weight-Average Molecular Weight (Mw)/Number-Average Molecular Weight (Mn)

The weight-average molecular weight (Mw) of the toner measured by gel permeation chromatography (GPC) performed on the tetrahydrofuran (THF) soluble components (hereinafter also referred to as "weight-average molecular weight of the toner") may be in the range of 5,000 to 50,000. When the weight-average molecular weight (Mw) of the toner is in this range, blocking resistance, development durability, and low-temperature fixability can be improved and high-gloss images can be produced. The weight-average molecular weight (Mw) of the toner can be controlled by adjusting the amount and the weight-average molecular weight (Mw) of the low-molecular-weight resin added, the reaction temperature and reaction time for toner production, and the amount of initiator, the amount of the chain transfer agent, and the amount of the crosslinking agent used for toner production.

The ratio (Mw/Mn) of the weight-average molecular weight (Mw) to the number-average molecular weight (Mn) of the toner determined by GPC performed on the tetrahydrofuran (THF) soluble components is preferably in the range of 5.0 to 100.0 and more preferably in the range of 5.0 to 30.0. When the Mw/Mn is within this range, the range in which fixing is possible can be widened.

Method for Measuring and Evaluating Physical Properties of Toner Particles or Toner Methods for measuring and evaluating physical properties of the toner particles or toner will now be described.

Method for Determining Structure of Organic Silicon Polymer

Method for Preparing THF Insoluble Components of Toner Particles

The THF insoluble components of the toner particles are prepared as follows.

Ten grams of a toner is weighed, placed in a cylindrical filter (for example, No. 86R produced by Toyo Roshi Kaisha, Ltd.), and loaded in a Soxhlet extractor. Extraction is conducted for 20 hours by using 200 mL of THF as a solvent and the residue in the cylindrical filter is vacuum dried for several hours at 40° C. The resulting product is assumed to be the THF insoluble components of the toner particles for NMR measurement.

Method for Confirming Presence of Unit Represented by Formula (1) or (2) Above

The presence of the unit represented by formula (1) or (2) above is confirmed by checking whether a methine group bonded to the silicon atom in formula (1) (>CH—Si) is present or not or whether a methylene group bonded to the silicon atom in formula (2) (—$CH_2$—Si) is present or not by $^{13}$C-NMR.

Measurement conditions for $^{13}$C-NMR (solid)

Instrument: AVANCE III 500 produced by Bruker Corporation

Probe: 4 mm MAS BB/1H

Measurement temperature: room temperature

Sample rotation speed: 6 kHz

Sample: 150 mg of a measurement sample (THF insoluble components of the toner particles for NMR measurement) is placed in a sample tube having a diameter of 4 mm.

Measurement nuclear frequency: 125.77 MHz

Reference substance: Glycine (external standard: 176.03 ppm)

Measurement width: 37.88 kHz

Measurement method: CP/MAS

Contact time: 1.75 ms

Repeating time: 4 s

Number of transients: 2048

LB value: 50 Hz

The presence of the unit represented by formula (1) above is confirmed by confirming whether a signal attributable to the methine group bonded to the silicon atom in formula (1) (>CH—Si) is detected.

The presence of the unit represented by formula (2) above is confirmed by confirming whether a signal attributable to the methylene group bonded to the silicon atom in formula (2) (—$CH_2$—Si) is detected.

Concentration (Atomic %) of Silicon Present at Surfaces of Toner Particles

Surface composition analysis is conducted by electron spectroscopy for chemical analysis (ESCA) to determine the ratio of the silicon concentration (atomic %) to the total (dC+dO+dSi) of the carbon concentration dC, the oxygen concentration dO, and the silicon concentration dSi at the surfaces of the toner particles.

The system used for ESCA and the measurement conditions are as follows.

System used: Quantum 2000 produced by ULVAC-PHI Incorporated

ESCA measurement conditions: X-ray source: AlKα

X-ray: 100 μm, 25 W, 15 kV

Raster: 300 μm×200 μm

Pass energy: 58.70 eV

Step size: 0.125 eV

Neutralizing electron gun: 20 μA, 1 V
Ar ion gun: 7 mA, 10 V
Number of sweeps: 15 for Si, 10 for C, and 5 for O The observed peak intensities of the respective elements are used to calculate the surface atomic concentrations (atomic %) by using relative sensitivity factors provided by ULVAC-PHI Incorporated.

Method for Determining Shape Factor SF-2 of Toner

To determine the shape factor SF-2 of the toner, a cross section of a toner is prepared as described below by using a cross section polisher "SM-09010" (produced by JEOL Ltd.). A Mo mesh (diameter: 3 mm, thickness: 30 μm) is placed on a silicon wafer, colloidal graphite is applied thereto, and the toner is allowed to adhere on the applied colloidal graphite. During this process, about one layer of the toner is adhered under observation with a microscope. The toner is subjected to platinum deposition. Cross sections are prepared by using a cross-section polisher at an acceleration voltage of 3 kV and a process time of 10 hours.

Each cross-section prepared as such is magnified 1000 fold by using FE-SEM (S-4800) produced by Hitachi Ltd., and observed.

The observed image is analyzed with image analysis software "analySIS Pro" (produced by OLYMPUS CORPORATION) to determine the peripheral length PERI and the cross sectional area AREA of a toner cross section. The equivalent circle diameter Dsem is determined from the peripheral length of the toner using the equation, equivalent circle diameter Dsem=peripheral length PERI/π. Those particles which have a Dsem within the range of ±1.0% of the weight-average particle size determined by the procedure described below using a Coulter Counter are assumed to be the subject particles.

One hundred subject particles are arbitrarily chosen. The average of peripheral lengths of their cross sections is assumed to be PERIav. and the average of the cross sectional areas is assumed to be AREAav. Then the shape factor SF-2 of the toner is determined from the equation below:

$$SF-2=\frac{(PERIav.)^2}{AREAav.}\times\frac{1}{4\pi}\times 100$$

Method for Measuring Average Circularity and Mode Circularity of Toner

The average circularity of the toner is measured with a dynamic flow particle imaging instrument EPIA-3000 (produced by Sysmex Corporation) under the measurement and analytical conditions used in calibration operation.

To 20 mL of ion exchange water, an appropriate amount of a surfactant, which is preferably an alkyl benzene sulfonic acid salt, is added as a dispersant and then 0.02 g of the measurement sample is added thereto. The resulting mixture is dispersed for 2 minutes in a desktop-type ultrasonic cleaner disperser (for example, VS-150 produced by Velvo-Clear) at an oscillation frequency of 50 kHz and a power output of 150 W to prepare a dispersion for measurement. During this process, cooling is appropriately conducted so that the temperature of the dispersion is within the range of 10° C. or more and 40° C. or less.

Prior to measurement, the above-mentioned dynamic flow particle imaging instrument equipped with a standard object lens (magnification of 10) is used and particle sheath PSE-900A (produced by Sysmex Corporation) is used as the sheath solution. The dispersion prepared by the above-mentioned procedure is introduced into the dynamic flow particle imaging instrument and 3000 toner particles are measured at a total count mode and HPF measurement mode. The binarization threshold during the particle analysis is set to 85% and the analytic particle diameter is limited to an equivalent circle diameter of 1.98 μm or more and 19.92 μm or less so as to determine the average circularity of the toner.

In measurement, automatic focus adjustment is conducted by using standard latex particles (for example, 5100A produced by Duke Scientific Corporation diluted with ion exchange water). After the start of the measurement, focus adjustment may be performed every two hours.

In the circularity distribution of the toner, a mode circularity of 0.98 to 1.00 means that most of toner particles have a shape close to spherical. At this circularity, the adhesion force of the toner to the photosensitive member attributable to image force and Van der Waals force is significantly decreased and the transfer efficiency is significantly increased.

The circularity is divided into sixty-one circularity classes ranging from a circularity of 0.40 to 1.00 at 0.01 intervals (for example, one class ranges from 0.40 to less than 0.41, the next class ranges from 0.41 to less than 0.42, and the last class ranges from 0.99 to less than 1.00). The observed circularities of the respective particles measured are assigned to corresponding classes and one of these classes where the highest number of particles are allotted in the circularity frequency distribution is assumed to be the mode circularity.

Average thickness Dav. of surface layers of toner particles, number of non-adjacent line segments having lengths equal to or smaller than RAav×0.90, and percentage of the surface layer thicknesses that are 5.0 nm or less determined by cross-sectional observation of toner particles with transmission electron microscope (TEM)

Cross sections of the toner particles can be observed by the following procedure.

First, toner particles are dispersed in an epoxy resin curable at room temperature. The resulting dispersion is left in a 40° C. atmosphere for 2 days to cure the epoxy resin. Thin samples are cut out from the resulting cured product by using a microtome equipped with diamond knives. The cross section of each sample is observed with a transmission electron microscope (TEM) at a magnification of ×10,000 to ×100,000. For the purposes of the present invention, observation is performed by utilizing the difference in atomic weight between the binder resin used and the organic silicon polymer since a portion with a higher atomic weight appears in light color. Moreover, in order to enhance the contrast between different materials, a ruthenium tetraoxide staining method or an osmium tetraoxide staining method may be employed.

A TEM bright field image is acquired by using an electron microscope, Tecnai TF20XT produced by FEI Company at an acceleration voltage of 200 kV. Then an EF mapping image of a Si—K edge (99 eV) is acquired by a three window method by using an EELS detector, GIF Tridiem produced by Gatan Inc., so as to confirm presence of the organic silicon polymer at the surface layer.

Note that the toner particles that are observed with TEM and used to determine the average thickness Dav. of the surface layers of the toner particles, the number of non-adjacent line segments having a length equal to or smaller than RAav×0.90, and the percentage (existing ratio) of the surface layer thicknesses that are 5.0 nm or less are those toner particles which have a circle equivalent diameter $D_{tem}$ within the range of ±10% of the weight-average particle size of the toner determined by the method described below by using a Coulter counter, where the circle equivalent diameter $D_{tem}$ is determined from the cross sections of the toner particles in a TEM image.

In a cross section of a toner particle subject to observation, sixteen straight lines that pass through the midpoint of a long axis L, which is a maximum diameter of the cross section, and extend across the cross section are drawn such that the intersectional angles at the midpoint are equal to each other (namely, 11.25°) with reference to the long axis L and that thirty-two line segments $RA_n$ (n=1 to 32) that extend from the midpoint to the surface of the toner particle are formed (refer to FIG. 1). The length of each line segment is assumed to be $Ar_n$ (n=1 to 32), the average of the lengths $Ar_n$ is assumed to be RAav, and the thickness of the surface layer that lies on the line segment $RA_n$ is assumed to be $FAr_n$ (n=1 to 32). Based on these parameters, the average Dav. of thicknesses of an organic silicon polymer-containing surface layer of a toner particle on the thirty-two line segment, the number of non-adjacent line segments that have lengths equal to or smaller than RAav×0.90, and the percentage (existing ratio) of the surface layer thicknesses that are 5.0 nm or less out of the surface layer thicknesses $FAr_n$ are determined.

Equivalent Circle Diameter $D_{tem}$av. Determined from Cross Sections of Toner in TEM Image The equivalent circle diameter $D_{tem}$av. is determined from the cross sections of the toner particles in a TEM image according to the procedure described below.

First, an equivalent circle diameter $D_{tem}$ of one toner particle is determined from the cross section of the toner particle in a TEM image.

$$D_{tem}=(Ar_1+Ar_2+Ar_3+Ar_4+Ar_5+Ar_6+Ar_7+Ar_8+Ar_9+Ar_{10}+Ar_{11}+Ar_{12}+Ar_{13}+Ar_{14}+Ar_{15}+Ar_{16}+Ar_{17}+Ar_{18}+Ar_{19}+Ar_{20}+Ar_{21}+Ar_{22}+Ar_{23}+Ar_{24}+Ar_{25}+Ar_{26}+Ar_{27}+Ar_{28}+Ar_{29}+Ar_{30}+Ar_{31}+Ar_{32})/16$$

This measurement and calculation are conducted on ten toner particles. The observed equivalent circle diameters are averaged and the result is assumed to be the equivalent circle diameter $D_{tem}$av. determined from cross sections of the toner particles.

Average Thickness Dav. of Surface Layer of Toner Particle

The average thickness Dav. of the toner particle surface layer is determined by the following procedure.

First, the average thickness $D_{(n)}$ of a surface layer of one toner particle is determined by the following equation:

$$D_{(n)}=\text{Total of surface layer thicknesses at thirty-two positions on the line segments}/32$$

This calculation is conducted on ten toner particles. The resulting average thicknesses $D_{(n)}$ (n=1 to 10) of the toner particles are averaged in accordance with the equation below to determine the average thickness Dav. of the surface layers of the toner particles.

$$Dav.=\{D_{(1)}+D_{(2)}+D_{(3)}+D_{(4)}+D_{(5)}+D_{(6)}+D_{(7)}+D_{(8)}+D_{(9)}+D_{(10)}\}/10$$

Percentage of Surface Layer Thicknesses that are 5.0 nm or Less Out of Thicknesses $FAr_n$ of the Surface Layer of the Toner Particle The percentage (existing ratio) of the surface layer thicknesses that are 5.0 nm or less out of the thicknesses $FAr_n$ of the surface layer is determined by the following procedure.

First, the percentage of the surface layer thicknesses that are 5.0 nm or less is determined from the following equation for one particle.

$$\text{(Percentage of surface layer thicknesses that are 5.0 nm or less)}=((\text{the number of surface layer thicknesses } FAr_n \text{ that are 5.0 nm or less})/32)\times 100$$

This calculation is conducted on ten toner particles. The obtained results are averaged and the result is assumed to be the percentage of the surface layer thicknesses that are 5.0 nm or less out of the thicknesses $FAr_n$ of the surface layer of the toner particle.

Number of Non-Adjacent Line Segments Having Lengths Equal to or Smaller than RAav×0.90

The average value RAav of the lengths $Ar_n$ of line segments each extending from the midpoint of a long axis L, which is the largest diameter of the cross section of a toner particle, to the surface of the toner particle is determined by the method described below.

First, the average value RAav of the lengths $Ar_n$ observed in a cross section of a toner particle in a Tem image is calculated by using the following equation for one toner particle.

$$RA\text{av}=(Ar_1+Ar_2+Ar_3+Ar_4+Ar_5+Ar_6+Ar_7+Ar_8+Ar_9+Ar_{10}+Ar_{11}+Ar_{12}+Ar_{13}+Ar_{14}+Ar_{15}+Ar_{16}+Ar_{17}+Ar_{18}+Ar_{19}+Ar_{20}+Ar_{21}+Ar_{22}+Ar_{23}+Ar_{24}+Ar_{25}+Ar_{26}+Ar_{27}+Ar_{28}+Ar_{29}+Ar_{30}+Ar_{31}+Ar_{32})/32$$

The number of line segments that have a length equal to or smaller than RAav×0.90 is determined. During this process, the line segments that have lengths equal to or smaller than RAav×0.90 but that are adjacent to each other (n is consecutive) are excluded from the count.

The obtained result is assumed to be the number of non-adjacent line segments that have length equal to or less than RAav×0.90 in a TEM image.

Method for Measuring Weight-Average Molecular Weight (Mw), Number-Average Molecular Weight (Mn), and Main Peak Molecular Weight (Mp) of Toner and Various Resins The weight-average molecular weight (Mw), number-average molecular weight (Mn), and main peak molecular weight (Mp) of the toner and various resins are determined by gel permeation chromatography (GPC) under the following conditions.

Measurement Conditions

Columns (produced by Showa Denko K.K.): seven-column combination including Shodex GPC KF-801, KF-802, KF-803, KF-804, KF-805, KF-806, and KF-807 (diameter: 8.0 mm, length: 30 cm)

Eluent: tetrahydrofuran (THF)

Temperature: 40° C.

Flow rate: 0.6 mL/min

Detector: RI

Concentration and amount of sample: 10 μl of a 0.1 mass % sample

Sample Preparation

In 20 mL of tetrahydrofuran, 0.04 g of a subject of measurement (toner or resin) is dispersed and dissolved. The resulting mixture is left standing still for 24 hours and filtered with a 0.2 μm filter (Pretreatment Disk H-25-2 produced by Tosoh Corporation). The filtrate is used as a sample.

Molecular weight calibration curves prepared from monodisperse polystyrene standard samples are used as the calibration curves. The standard polystyrene samples used for plotting calibration curves are TSK standard polystyrene F-850, F-450, F-288, F-128, F-80, F-40, F-20, F-10, F-4, F-2, F-1, A-5000, A-2500, A-1000, and A-500 produced by Tosoh Corporation. At least ten standard polystyrene samples are to be used.

In determining the GPC molecular weight distribution, the measurement is started from the point where the chromatogram is rising from the baseline on the high-molecular-weight side and conducted up to a molecular weight of about 400 on the low-molecular-weight side.

Method for Measuring Glass Transition Temperature (Tg) of Toner and Various Resins The glass transition temperature (Tg) of the toner and various resins is measured with a differential scanning calorimeter (DSC) M-DSC (trade name: Q1000, produced by TA-Instruments) by the following procedure. First, 6 mg of a sample to be measured (toner or resin) is accurately weighed and placed in an aluminum pan. While using an empty aluminum pan as a reference, measurement is conducted in the measurement temperature range of 20° C. to 200° C. at a heating rate of 1° C./min at normal temperature and normal humidity. The measurement is conducted at a modulation amplitude of ±0.5° C. and a frequency of 1/min. The glass transition temperature (Tg: ° C.) is calculated from the obtained reversing heat flow curve. The midpoint of a line connecting the intersections between the tangent line of the endothermic curve and the base lines before and after the endotherm is assumed to be the glass transition temperature Tg (° C.).

Figure 2:
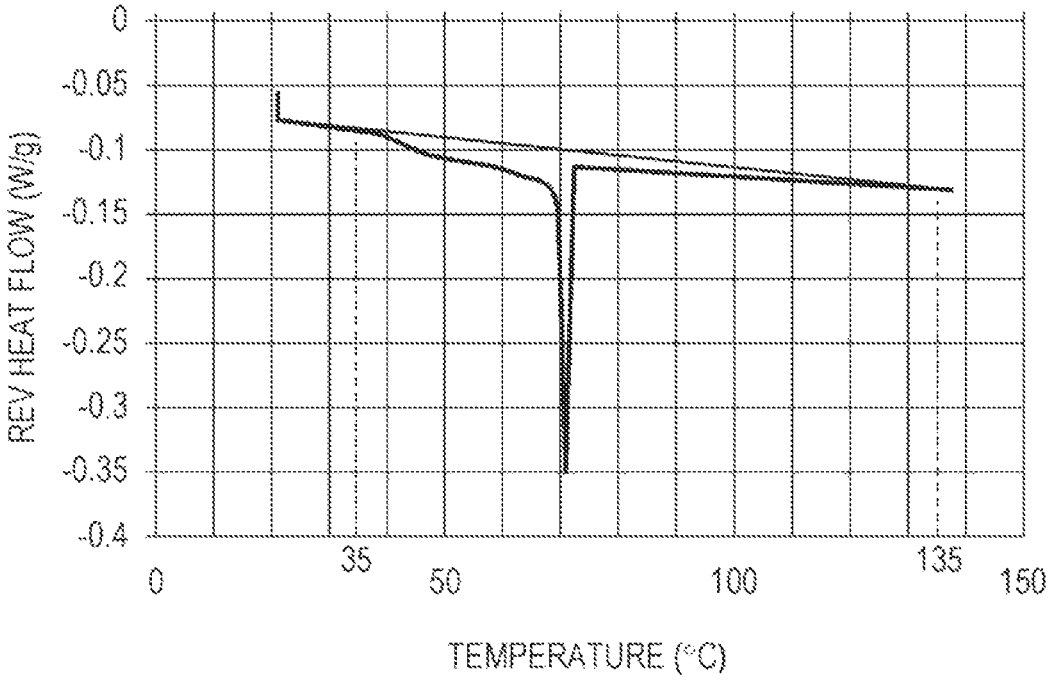
FIG. 2 is a diagram showing a reversing heat flow curve of a toner according to an embodiment of the present invention measured with a differential scanning calorimeter (DSC).

The integrated calorific value per gram of the toner (J/g) indicated by the peak area of the endothermic main peak in an endothermic chart during temperature elevation measured by DSC is measured. An example of a reversing flow curve obtained by DSC measurement on the toner is shown in FIG. 2.

The integrated calorific value (J/g) is determined by using the reversing flow curve obtained by the above-mentioned measurement. Analytic software, Universal Analysis 2000 for Windows 2000/XP Version 4.3A (produced by TA Instruments) is used in calculation. The integrated calorific value (J/g) is determined from the region defined by the endothermic curve and a straight line connecting the measurement points at 35° C. and 135° C. by using Integral Peak Linear function.

Method for Measuring Weight-Average Particle Size (D4) and Number-Average Particle Size (D1) of Toner The weight-average particle size (D4) and the number-average particle size (D1) of the toner are measured by using a precision particle size distribution analyzer equipped with a 100 μm aperture tube based on an aperture resistance method, namely, COULTER COUNTER Multisizer 3 (registered trade mark, product of Beckman Coulter Inc.) and bundled special software Beckman Coulter Multisizer 3 version 3.51 produced by Beckman Coulter Inc., for setting measurement conditions and analyzing the observed data. The number of effective measurement channels is 25,000. The observed data is analyzed to calculate D4 and D1.

The aqueous electrolytic solution used in the measurement is prepared by dissolving special grade sodium chloride in ion exchange water so that the concentration is about 1 mass %. An example of such a solution is ISOTON II produced by Beckman Coulter Inc.

Before conducting measurement and analysis, the setting of the special software is done as follows:

Set the total count of the control mode appearing in a "Change standard operating method (SOM)" window of the bundled software to 50,000 particles. Set the number of runs to 1 and Kd value to a value obtained by using "Standard particles 10.0 μm" produced by Beckman Coulter Inc. Press "Threshold/Noise level measurement button" to automatically set the threshold and the noise level. Set the current to 1600 μA, gain to 2, and electrolyte to ISOTON II. Check the "Flush aperture tube after run" box.

In the "Convert Pulse to Size Settings" window of the bundled software, set the bin spacing to log diameter, size bin to 256 size bin, and size range to 2 μm to 60 μm.

A specific measurement method is as follows:

(1) Into a 250 mL round-bottomed glass beaker specially prepared for Multisizer 3, about 200 mL of the aqueous electrolytic solution is placed, the beaker is set in the sample stand, and anticlockwise stirring using a stirrer rod is conducted at 24 rotations/second. The contaminants and bubbles inside the aperture tube are preliminarily removed by "aperture flush" function of the software.

(2) Into a 100 mL flat-bottomed glass beaker, about 30 mL of the aqueous electrolytic solution is placed and about 0.3 mL of a diluted solution of a dispersing agent, "Contaminon N" (a 10 mass % aqueous solution of a neutral detergent for washing precision measurement instruments having pH of 7 and containing a nonionic surfactant, an anionic surfactant, and an organic builder, produced by Wako Pure Chemical Industries) diluted about 3 fold with ion exchange water on a mass basis is added thereto.

(3) A particular quantity of ion exchange water is placed in a water tank of an ultrasonic disperser, Ultrasonic Dispersion System Tetora 150 produced by Nikkaki Bios Co., Ltd., equipped with two oscillators having an oscillation frequency of 50 kHz with a 180 degree phase shift and an electrical output of 120 W. To the water tank, about 2 mL of Contaminon N is added.

(4) The beaker prepared in (2) is set in a beaker securing hole of the ultrasonic disperser and the ultrasonic disperser is operated. The height position of the beaker is adjusted so that the resonant state of the liquid surface of the aqueous electrolytic solution in the beaker is maximum.

(5) While applying ultrasonic waves to the electrolyte aqueous solution in the beaker in (4), about 10 mg of the toner is added to the aqueous electrolytic solution in small divided portions to conduct dispersion. The ultrasonic dispersion treatment is continued further for 60 seconds. During the process of ultrasonic dispersion, the water temperature of the water tank is adjusted to be in a range of 10° C. or more and 40° C. or less.

(6) The ultrasonically dispersed aqueous electrolytic solution containing dispersed toner prepared in (5) is added dropwise using a pipette to the round-bottomed beaker prepared in (1) installed in the sample stand to adjust the measurement concentration to about 5%. Run is repeated until the count of particles reaches 50,000.

(7) The measurement data is analyzed with special software installed in the instrument to calculate the weight-average particle diameter (D4) and the number-average particle diameter (D1). The weight-average particle diameter (D4) is the number in "Average Diameter" of the "Analysis/volume statistic values (arithmetic mean)" window on Graph/Volume % setting, and the number-average particle diameter (D1) is the number in "Average Diameter" of the "Analysis/number statistic values (arithmetic mean)" window on Graph/Number % setting.

The present invention will now be described in further detail by using Examples which do not limit the scope of the present invention. In the description below, "parts" means parts by mass unless otherwise noted.

Production Examples of the charge control resin used in embodiments of the present invention will now be described.

Production Example of Charge Control Resin 1

To a reactor equipped with a reflux duct, a stirrer, a thermometer, a nitrogen duct, a dropper, and a decompressor, 255.0 parts by mass of methanol, 145.0 parts by mass of 2-butanone, and 100.0 parts by mass of 2-propanol were added as solvents and 88.0 parts by mass of styrene, 6.2 parts by mass of 2-ethylhexyl acrylate, and 6.6 parts by mass of 2-acrylamide-2-methylpropane sulfonic acid were added as monomers. The resulting mixture was heated while being stirred at normal pressure under refluxing. Thereto, a solution prepared by diluting 0.8 parts by mass of a polymerization initiator, 2,2'-azobisisobutyronitrile with 20.0 parts by mass of 2-butanone was added dropwise for 30 minutes and stirring was continued for 5 hours. A solution prepared by diluting 1.2 part by mass of 2,2'-azobisisobutyronitrile with 20.0 parts by mass of 2-butanone was added thereto dropwise for 30 minutes and stirring was conducted for 5 hours at normal pressure under refluxing to terminate the polymerization.

Next, the polymer obtained by distilling away the polymerization solvents at a reduced pressure was roughly pulverized to 100 μm or less with a cutter mill equipped with a 150 mesh screen and then finely pulverized with a jet mill. The resulting fine particles were classified with a 250 mesh sieve, and particles having a size of 60 μm or under were obtained by the classification. These particles were dissolved in methyl ethyl ketone to a concentration of 10% and the resulting solution was slowly added to methanol in an amount 20 times greater than that of methyl ethyl ketone so as to perform reprecipitation. The precipitates obtained were washed with methanol in an amount half that used for reprecipitation and the filtered particles were vacuum dried at 35° C. for 48 hours.

The particles after vacuum drying was re-dissolved in methyl ethyl ketone to a concentration of 10% and the resulting solution was slowly added to n-hexane in an amount 20 times greater than that of methyl ethyl ketone so as to perform reprecipitation. The precipitates obtained were washed with n-hexane in an amount half that used for reprecipitation and the filtered particles were vacuum dried at 35° C. for 48 hours. The resulting charge control resin had a Tg of about 82° C., a main peak molecular weight (Mp) of 19,300, a number-average molecular weight (Mn) of 12,700, and a weight-average molecular weight (Mw) of 21,100. The acid value was 20.4 mgKOH/g. The obtained resin was named "charge control resin 1".

Production Example of Polyester-Based Resin (1)

The following monomers were charged in an autoclave along with an esterification catalyst:

terephthalic acid: 11.1 mol bisphenol A-propylene oxide 2 mol adduct (PO-BPA): 10.8 mol A decompressor, a water separator, a nitrogen gas introducing system, a temperature measurement system, and a stirrer were attached to the autoclave and the reaction was conducted in a nitrogen atmosphere at a reduced pressure according to a normal procedure at 220° C. until Tg was 70° C. As a result, a polyester-based resin (1) was obtained. The weight-average molecular weight (Mw) was 8,200 and the number-average molecular weight (Mn) was 3,220.

Production Example of Polyester-Based Resin (2)

Synthesis of Isocyanate Group-Containing Prepolymer

The following materials were reacted at 220° C. for 7 hours under stirring:

bisphenol A ethylene oxide 2 mol adduct: 720.0 parts by mass phthalic acid: 280.0 parts by mass dibutyl titanium oxide: 2.5 parts by mass Then the reaction was continued at a reduced pressure for 5 hours. The resulting product was cooled to 80° C., reacted with 190.0 parts by mass of isophorone diisocyanate in ethyl acetate for 2 hours. As a result, an isocyanate group-containing polyester resin was obtained. The isocyanate group-containing polyester resin (26.0 parts by mass) and 1.0 part by mass of isophorone diamine were reacted at 50° C. for 2 hours. As a result, a polyester-based resin (2) containing a urea group-containing polyester as a main component was obtained. The resulting polyester-based resin (2) had a weight-average molecular weight (Mw) of 25,000, a number-average molecular weight (Mn) of 3200, and a peak molecular weight of 6200.

Production Example of Toner Particles 1

To a four-necked container equipped with a reflux duct, a stirrer, a thermometer, and a nitrogen duct, 700.0 parts by mass of ion exchange water, 1000.0 parts by mass of a 0.1 mol/L $Na_3PO_4$ aqueous solution, and 24.0 parts by mass of a 1.0 mol/L HCl aqueous solution were added. The resulting mixture was held at 60° C. while being stirred at 12,000 rpm using a high-speed stirrer, TK-Homomixer. To the resulting mixture, 85 parts by mass of a 1.0 mol/L $CaCl_2$ aqueous solution was slowly added to prepare an aqueous dispersion medium containing fine, slightly water-soluble dispersion stabilizer $Ca_3(PO_4)_2$.

The following materials were dispersed for three hours using an attritor to prepare a polymerizable monomer composition 1:

styrene: 70.0 parts by mass n-butyl acrylate: 30.0 parts by mass divinylbenzene: 0.1 parts by mass vinyltriethoxysilane: 15.0 parts by mass copper phthalocyanine pigment (Pigment Blue 15:3): 6.5 parts by mass polyester-based resin (1): 5.0 parts by mass charge control agent 1 (aluminum compound of 3,5-di-tert-butyl salicylic acid): 0.5 parts by mass charge control resin 1: 0.5 parts by mass release agent (behenyl behenate, endothermic main peak temperature: 72.1° C.): 10.0 parts by mass The polymerizable monomer composition 1 was held at 60° C. for 20 minutes. The polymerizable monomer composition 1 and 14.0 parts by mass (50% toluene solution) of tert-butyl peroxypivalate serving as a polymerization initiator were placed in an aqueous medium. The resulting mixture was stirred with a high-speed stirrer at a rotation speed of 12,000 rpm for 10 minutes to form particles. The high-speed stirrer was changed to a propeller-type stirrer. The inner temperature was increased to 70° C. and the reaction was performed for 5 hours under slow stirring. The pH of the aqueous medium at this stage was 5.0. Then the temperature in the reactor was increased to 85° C. and held thereat for 5 hours. Thereto, 300.0 parts by mass of ion exchange water was added, the reflux duct was removed, and a distillator was attached. Distillation was conducted for 5 hours while maintaining the temperature inside the reactor to 100° C., and a polymer slurry 1 was obtained as a result. The amount of the distillate fraction was 310.0 parts by mass. Diluted hydrochloric acid was added to a reactor containing the polymer slurry 1 after being cooled to 30° C. so as to remove the dispersion stabilizer. Filtration, washing, and drying were performed on the resulting product and toner particles having a weight-average particle size of 5.6 μm were obtained as a result. These toner particles were assumed to be toner particles 1. The formulation and conditions of the toner particles 1 are shown in Table 1 and physical properties thereof are shown in Table 7.

Production Example of Toner Particles 2

Toner particles 2 were obtained as in Production Example of toner particles 1 except that 15.0 parts by mass of allyltriethoxysilane was used instead of 15.0 parts by mass of vinyltriethoxysilane used in Production Example of toner particles 1. The formulation and conditions of the toner particles 2 are shown in Table 1 and the physical properties thereof are shown in Table 7.

Production Example of Toner Particles 3

Toner particles 3 were obtained as in Production Example of toner particles 1 except that 30.0 parts by mass of butyl methacrylate was used instead of 30.0 parts by mass of n-butyl acrylate used in Production Example of toner particles 1. The formulation and conditions of the toner particles 3 are shown in Table 1 and the physical properties thereof are shown in Table 7.

Production Example of Toner Particles 4

Toner particles 4 were obtained as in Production Example of toner particles 1 except that 29.0 parts by mass of n-butyl acrylate and 1.0 part by mass of acrylic acid were used instead of 30.0 parts by mass of n-butyl acrylate used in Production Example of toner particles 1. The formulation and conditions of the toner particles 4 are shown in Table 1 and the physical properties thereof are shown in Table 7.

Production Example of Toner Particles 5

Toner particles 5 were obtained as in Production Example of toner particles 1 except that 29.0 parts by mass of n-butyl acrylate and 1.0 part by mass of behenyl acrylate were used instead of 30.0 parts by mass of n-butyl acrylate used in Production Example of toner particles 1. The formulation and conditions of the toner particles 5 are shown in Table 1 and the physical properties thereof are shown in Table 7.

Production Example of Toner Particles 6

Toner particles 6 were obtained as in Production Example of toner particles 1 except that 15.0 parts by mass of vinyltrimethoxysilane was used instead of 15.0 parts by mass of vinyltriethoxysilane used in Production Example of toner particles 1. The formulation and conditions of the toner particles 6 are shown in Table 1 and the physical properties thereof are shown in Table 7.

Production Example of Toner Particles 7

Toner particles 7 were obtained as in Production Example of toner particles 1 except that 15.0 parts by mass of vinyltriisopropoxysilane was used instead of 15.0 parts by mass of vinyltriethoxysilane used in Production Example of toner particles 1. The formulation and conditions of the toner particles 7 are shown in Table 1 and the physical properties thereof are shown in Table 7.

Production Example of Toner Particles 8

Toner particles 8 were obtained as in Production Example of toner particles 1 except that 15.0 parts by mass of vinyldiethoxychlorosilane was used instead of 15.0 parts by mass of vinyltriethoxysilane used in Production Example of toner particles 1 and that the pH was adjusted to 5.0 by using 2.0 parts by mass of 1.0 N—NaOH aqueous solution. The formulation and conditions of the toner particles 8 are shown in Table 1 and the physical properties thereof are shown in Table 7.

Production Example of Toner Particles 9

Toner particles 9 were obtained as in Production Example of toner particles 1 except that 50.0 parts by mass of vinyltriethoxysilane was used instead of 15.0 parts by mass of vinyltriethoxysilane used in Production Example of toner particles 1. The formulation and conditions of the toner particles 9 are shown in Table 1 and the physical properties thereof are shown in Table 7.

Production Example of Toner Particles 10

Toner particles 10 were obtained as in Production Example of toner particles 1 except that 30.0 parts by mass of vinyltriethoxysilane was used instead of 15.0 parts by mass of vinyltriethoxysilane used in Production Example of toner particles 1. The formulation and conditions of the toner particles 10 are shown in Table 1 and the physical properties thereof are shown in Table 7.

Production Example of Toner Particles 11

Toner particles 11 were obtained as in Production Example of toner particles 1 except that 10.5 parts by mass of vinyltriethoxysilane was used instead of 15.0 parts by mass of vinyltriethoxysilane used in Production Example of toner particles 1. The formulation and conditions of the toner particles 11 are shown in Table 1 and the physical properties thereof are shown in Table 7.

Production Example of Toner Particles 12

Toner particles 12 were obtained as in Production Example of toner particles 1 except that 9.5 parts by mass of vinyltriethoxysilane was used instead of 15.0 parts by mass of vinyltriethoxysilane used in Production Example of toner particles 1. The formulation and conditions of the toner particles 12 are shown in Table 1 and the physical properties thereof are shown in Table 7.

Production Example of Toner Particles 13

Toner particles 13 were obtained as in Production Example of toner particles 1 except that 5.0 parts by mass of vinyltriethoxysilane was used instead of 15.0 parts by mass of vinyltriethoxysilane used in Production Example of toner particles 1. The formulation and conditions of the toner particles 13 are shown in Table 2 and the physical properties thereof are shown in Table 8.

Production Example of Toner Particles 14

Toner particles 14 were obtained as in Production Example of toner particles 1 except that 4.0 parts by mass of vinyltriethoxysilane was used instead of 15.0 parts by mass of vinyltriethoxysilane used in Production Example of toner particles 1. The formulation and conditions of the toner particles 14 are shown in Table 2 and the physical properties thereof are shown in Table 8.

Production Example of Toner Particles 15

Toner particles 15 were obtained as in Production Example of toner particles 1 except that 5.0 parts by mass of allyltriethoxysilane was used instead of 15.0 parts by mass of vinyltriethoxysilane used in Production Example of toner particles 1. The formulation and conditions of the toner particles 15 are shown in Table 2 and the physical properties thereof are shown in Table 8.

Production Example of Toner Particles 16

Toner particles 16 were obtained as in Production Example of toner particles 1 except that 4.0 parts by mass of allyltriethoxysilane was used instead of 15.0 parts by mass of vinyltriethoxysilane used in Production Example of toner particles 1. The formulation and conditions of the toner particles 14 are shown in Table 2 and the physical properties thereof are shown in Table 8.

Production Example of Toner Particles 17 Preparation of toner base bodies 17

The following materials were mixed in a Henschel mixer:

polyester-based resin (1): 60.0 parts by mass polyester-based resin (2): 40.0 parts by mass copper phthalocyanine pigment (Pigment Blue 15:3): 6.5 parts by mass charge control agent 1 (aluminum compound of 3,5-di-tert-butyl salicylic acid): 0.5 parts by mass charge control resin 1: 0.5 parts by mass release agent (behenyl behenate, endothermic main peak temperature: 72.1° C.): 10.0 parts by mass The resulting mixture was melt kneaded with a two-shaft mixing extruder at 135° C. and the kneaded product was cooled, roughly pulverized with a cutter mill, finely pulverized with a fine grinder that uses jet stream, and classified with an air classifier. As a result, toner base bodies 17 having a weight-average particle size of 5.6 μm were obtained.

Preparation of Toner Particles 17

To a four-necked reactor equipped with a Liebig reflux condenser, 700.0 parts by mass of on exchange water, 1000.0 parts by mass of a 0.1 mol/L $Na_3PO_4$ aqueous solution, and 24.0 parts by mass of a 1.0 mol/L HCl aqueous solution were added. The resulting mixture was held at 60° C. while being stirred at 12,000 rpm using a high-speed stirrer, TK-Homomixer. To the resulting mixture, 85 parts by mass of a 1.0 mol/L $CaCl_2$ aqueous solution was slowly added to prepare an aqueous dispersion medium containing fine, slightly water-soluble dispersion stabilizer $Ca_3(PO_4)_2$.

Next, 100.0 parts by mass of the toner base bodies 17 and 15.0 parts by mass of vinyltriethoxysilane were mixed in a Henschel mixer. The resulting mixture was then stirred in a TK-Homomixer at 5,000 rpm and toner materials were added thereto, followed by stirring for 5 minutes. The resulting mixture was held at 70° C. for 5 hours. The pH was 5.0. The temperature was increased to 85° C. and held thereat for 5 hours. Then 300.0 parts by mass of ion exchange water was added, the reflux condenser was removed, and a distillator was attached. Distillation was conducted for 5 hours while maintaining the temperature inside the reactor to 100° C. and a polymer slurry 17 was obtained as a result. The amount of the distillation fraction was 315.0 parts by mass. Diluted hydrochloric acid was added to the reactor containing the polymer slurry 17 to remove the dispersion stabilizer. Then filtration, washing, and drying were conducted and toner particles having a weight-average particle size of 5.6 μm were obtained as a result. These toner particles were used as toner particles 17. The physical properties of the toner particles 17 are shown in Table 8.

Production Example of Toner Particles 18

The following materials were dissolved in 400.0 parts by mass of toluene to obtain a solution:

polyester-based resin (1): 60.0 parts by mass polyester-based resin (2): 40.0 parts by mass copper phthalocyanine pigment (Pigment Blue 15:3): 6.5 parts by mass charge control agent 1 (aluminum compound of 3,5-di-tert-butyl salicylic acid): 0.5 parts by mass charge control resin 1: 0.5 parts by mass vinyltriethoxysilane: 15.0 parts by mass release agent (behenyl behenate, endothermic main peak temperature: 72.1° C.): 10.0 parts by mass To a four-necked reactor equipped with a Liebig reflux condenser, 700.0 parts by mass of ion exchange water, 1000.0 parts by mass of a 0.1 mol/L $Na_3PO_4$ aqueous solution, and 24.0 parts by mass of a 1.0 mol/L HCl aqueous solution were added. The resulting mixture was held at 60° C. while being stirred at 12,000 rpm using a high-speed stirrer, TK-Homomixer. To the resulting mixture, 85.0 parts by mass of a 1.0 mol/L $CaCl_2$ aqueous solution was slowly added to prepare an aqueous dispersion medium containing fine, slightly water-soluble dispersion stabilizer $Ca_2(PO_4)_2$.

Next, 100.0 parts by mass of the solution was added to the mixture by using a TK-Homomixer under stirring at 12,000 rpm. The stirring was conducted for 5 minutes after the addition. The resulting mixture was held at 70° C. for 5 hours. The pH was 5.0. Then the temperature was increased to 85° C. and held thereat for 5 hours. Then 300.0 parts by mass of ion exchange water was added, the reflux condenser was removed, and a distillator was attached. Distillation was conducted for 5 hours while maintaining the temperature inside the reactor to 100° C. and a polymer slurry 18 was obtained as a result. The amount of the distillation fraction was 310.0 parts by mass. Diluted hydrochloric acid was added to the reactor containing the polymer slurry 18 to remove the dispersion stabilizer. Then filtration, washing, and drying were conducted and toner particles 18 having a weight-average particle size of 5.5 μm were obtained as a result. The physical properties of the toner particles 18 are shown in Table 8.

Production Example of Toner Particles 19

Synthesis of Amorphous Polyester Resin (1)

The following monomers were charged in a flask equipped with a stirrer, a nitrogen duct, a temperature sensor, and a rectifier:

bisphenol A ethylene oxide 2 mol adduct: 10 mol % bisphenol A propylene oxide 2 mol adduct: 90 mol % terephthalic acid: 50 mol % fumaric acid: 30 mol % dodecenylsuccinic acid: 20 mol %

The resulting mixture was heated to 190° C. in one hour and it was confirmed that the reaction system was being stirred uniformly.

Next, 0.7 weight % of tin distearate relative to the total weight of the monomers was added to the resulting mixture. The temperature was increased from 190° C. to 245° C. in 5 hours while distilling away water produced and dehydration condensation reaction was performed at 245° C. for 2 hours. As a result, an amorphous polyester resin (1) having a glass transition temperature of 57.2° C., an acid value of 13.4 mgKOH/g, a hydroxy value of 28.8 mgKOH/g, a weight-average molecular weight of 13,400, a number-average molecular weight of 3,900, and a softening point of 112° C. was obtained.

Synthesis of Amorphous Polyester Resin (2)

The following monomers were placed in a flask equipped with a stirrer, a nitrogen duct, a temperature sensor, and a rectifier:

bisphenol A ethylene oxide 2 mol adduct: 50 mol % (2 mol adduct on a dual end basis)

bisphenol A propylene oxide 2 mol adduct: 50 mol % (2 mol adduct on a dual end basis)

terephthalic acid: 65 mol % dodecenylsuccinic acid: 28 mol %

The resulting mixture was heated to 200° C. in one hour and it was confirmed that the reaction system was being uniformly stirred. Next, 0.7 weight % of tin distearate relative to the total weight of the monomers was added to the resulting mixture. The temperature was increased from 200° C. to 250° C. in 5 hours while distilling away water produced and dehydration condensation reaction was performed at 250° C. for 2 hours. Then the temperature was decreased to 190° C., 7 mol % of trimellitic anhydride was slowly added to the mixture, and the reaction was continued at 190° C. for one hour. As a result, an amorphous polyester resin (2) having a glass transition temperature of 56.2° C., an acid value of 11.8 mgKOH/g, a hydroxy value of 25.8 mgKOH/g, a weight-average molecular weight of 53,200, a number-average molecular weight of 6,800, and a softening point of 112° C. was obtained.

Preparation of Resin Particle Dispersion (1)

In a reactor, 50.0 parts by mass of methyl ethyl ketone and 25.0 parts by mass of isopropyl alcohol were placed. Thereto, 100.0 parts by mass of the amorphous polyester resin (1) was slowly added and completely dissolved under stirring. As a result, an amorphous polyester resin (1) solution was obtained.

The reactor containing the amorphous polyester resin (1) solution was set to 65° C. and a total of 5.0 parts by mass of a 10% ammonia aqueous solution was slowly added dropwise thereto under stirring. Then 230.0 parts by mass of ion exchange water was slowly added dropwise at a rate of 10 mL/min to perform phase-transfer emulsification. The pressure was reduced by using an evaporator to remove the solvent. As a result, a resin particle dispersion (1) of the amorphous polyester resin (1) was obtained. The volume-average particle size of the resin particles was 140 nm. The resin particle solid content was adjusted by ion exchange water to 20%.

Preparation of Resin Particle Dispersion (2)

In a reactor, 50.0 parts by mass of methyl ethyl ketone and 25.0 parts by mass of isopropyl alcohol were placed. Thereto, 100.0 parts by mass of the amorphous polyester resin (2) was slowly added and completely dissolved under stirring. As a result, an amorphous polyester resin (2) solution was obtained.

The reactor containing the amorphous polyester resin (2) solution was set to 40° C. and a total of 3.5 parts by mass of a 10% ammonia aqueous solution was slowly added dropwise thereto under stirring. Then 230.0 parts by mass of ion exchange water was slowly added dropwise at a rate of 10 mL/min to perform phase-transfer emulsification. The pressure was reduced to remove the solvent. As a result, a resin particle dispersion (2) of the amorphous polyester resin (2) was obtained. The volume-average particle size of the resin particles was 160 nm. The resin particle solid content was adjusted by ion exchange water to 20%.

Preparation of Sol-Gel Solution of Resin Particle Dispersion (1)

To 100.0 parts by mass (solid content: 20.0 parts by mass) of the resin particle dispersion (1), 20.0 parts by mass of vinyltriethoxysilane was added and the resulting mixture was stirred and held at 70° C. for one hour and then heated to 80° C. at a heating rate of 20° C./hour. The temperature was held thereat for 3 hours. The mixture was cooled and a sol-gel solution of the resin particle dispersion (1) in which the resin fine particles were coated with sol/gel was obtained as a result. The volume-average particle size of the resin particles was 225 nm. The resin particle solid content was adjusted with ion exchange water to 20%. The sol-gel solution of the resin particle dispersion (1) was stored at a temperature of 10° C. or lower while being stirred and used within 48 hours after preparation.

Preparation of Colorant Particle Dispersion 1

The following components were mixed: cyan pigment (ECB-308): 45.0 parts by mass ionic surfactant Neogen RK (produced by Dai-Ichi Kogyo Seiyaku Co., Ltd.): 5.0 parts by mass ion exchange water: 190.0 parts by mass.

The resulting mixture was dispersed for 10 minutes in a homogenizer (IKA Ultra Turrax) and dispersed at 250 MPa with Ultimizer (collision-type wet atomizer produced by Sugino Machine Limited) for 15 minutes. As a result, a colorant particle dispersion 1 having a colorant particle volume-average particle size of 135 nm and a solid content of 20% was obtained.

Preparation of Release Agent Particle Dispersion

The following materials were mixed and heated to 100° C.:

olefin wax (melting point: 84° C.): 60.0 parts by mass ionic surfactant Neogen RK (produced by Dai-Ichi Kogyo Seiyaku Co., Ltd.): 2.0 parts by mass ion exchange water: 240.0 parts by mass The mixture was then thoroughly dispersed in Ultra Turrax T50 produced by IKA, and heated to 110° C. and dispersed for 1 hour by using a pressure extrusion type Gaulin homogenizer. As a result, a release agent particle dispersion having a volume-average particle size of 170 nm and a solid content of 20% was obtained.

Preparation of Toner Particles 19

In a flask, 2.4 parts by mass of an ionic surfactant, Neogen RK was placed and then the following materials were added thereto:

resin particle dispersion (1): 100.0 parts by mass resin particle dispersion (2): 300.0 parts by mass sol-gel solution of resin particle dispersion (1): 300.0 parts by mass colorant particle dispersion 1: 50.0 parts by mass release agent particle dispersion: 50.0 parts by mass The resulting mixture was stirred. Then a 1 N nitric acid aqueous solution was added dropwise to the mixture to adjust the pH to 3.8, 0.4 parts by mass of polyaluminum sulfate was added thereto, and the resulting mixture was dispersed by using Ultra Turrax. The flask was heated to 48° C. under stirring in a heating oil bath and held at 48° C. for 40 minutes. Then 300.0 parts by mass of the sol-gel solution of the resin particle dispersion (1) was slowly added thereto.

Next, a 1 N sodium hydroxide aqueous solution was added to adjust the pH in the system to 7.0. The stainless steel flask was hermetically sealed, slowly heated to 85° C. under stirring, and retained at 85° C. for 4 hours. Then 2.0 parts by mass of an ionic surfactant, Neogen RK was added and reaction was conducted at 95° C. for 5 hours. After completion of the reaction, cooling and filtration were conducted. The product was re-dispersed in 5 L of ion exchange water at 40° C. The resulting dispersion was stirred for 15 minutes with a stirring blade (300 rpm) and filtered.

The re-dispersion and filtration were repeated to conduct washing and washing was ended when the electrical conductivity reached 7.0 μS/cm or lower. As a result, toner particles 19 were obtained. The formulation and conditions of the toner particles 19 are shown in Table 2 and the physical properties thereof are shown in Tables 5 and 8.

Production Example of Toner Particles 20

In a Henschel mixer, while 100.0 parts by mass of toner base bodies 17 were being stirred at high speed, 3.5 parts by mass of an organic silicon polymer solution prepared by reacting 10.0 parts by mass of toluene, 5.0 parts by mass of ethanol, 5.0 parts by mass of water, and 15.0 parts by mass of vinyltriethoxysilane at 85° C. for 5 hours was sprayed toward the toner base bodies 17.

Then the particles were circulated within a fluid-bed drier for 30 minutes at an inlet temperature of 80° C. and an outlet temperature of 45° C. to conduct drying and polymerization. The obtained processed toner was placed in a Henschel mixer and 3.5 parts by mass of the organic silicon polymer solution described above per 100 parts by mass of the processed toner was sprayed toward the processed toner. The processed toner was then circulated in a fluid-bed drier for 30 minutes at an inlet temperature of 80° C. and an outlet temperature of 45° C.

Spraying of the organic silicon polymer solution and drying were repeated a total of ten times to obtain toner particles 20. The physical properties of the toner particles 20 are shown in Table 8.

Production Example of Toner Particles 21

Toner particles 21 were obtained as in Production Example of toner particles 1 except that 60.0 parts by mass of styrene monomer was used instead of 70.0 parts by mass of styrene monomer and 40.0 parts by mass of n-butyl acrylate was used instead of 30.0 parts by mass of n-butyl acrylate used in Production Example of toner particles 1. The formulation and conditions of the toner particles 21 are shown in Table 2 and the physical properties thereof are shown in Table 8.

Production Example of Toner Particles 22

Toner particles 22 were obtained as in Production Example of toner particles 1 except that 6.0 parts by mass of Pigment Yellow 155 (P.Y. 155) was used instead of 6.5 parts by mass of copper phthalocyanine used in Production Example of toner particles 1. The formulation and conditions of the toner particles 22 are shown in Table 2 and the physical properties thereof are shown in Table 8.

Production Example of Toner Particles 23

Toner particles 23 were obtained as in Production Example of toner particles 1 except that 8.0 parts by mass of Pigment Red 122 (P.R. 122) was used instead of 6.5 parts by mass of copper phthalocyanine used in Production Example of toner particles 1. The formulation and conditions of the toner particles 23 are shown in Table 2 and the physical properties thereof are shown in Table 8.

Production Example of Toner Particles 24

Toner particles 24 were obtained as in Production Example of toner particles 1 except that 10.0 parts by mass of carbon black was used instead of 6.5 parts by mass of copper phthalocyanine used in Production Example of toner particles 1. The formulation and conditions of the toner particles 24 are shown in Table 2 and the physical properties thereof are shown in Table 8.

Production Example of Comparative Toner Particles 1

Comparative toner particles 1 were obtained as in Production Example of toner particles 1 except that 2.0 parts by mass of vinyltriethoxysilane was used instead of 15.0 parts by mass of vinyltriethoxysilane used in Production Example of toner particles 1. The formulation and conditions of the comparative toner particles 1 are shown in Table 3 and the physical properties thereof are shown in Table 9.

Production Example of Comparative Toner Particles 2

Comparative toner particles 2 were obtained as in Production Example of toner particles 1 except that 1.5 parts by mass of vinyltriethoxysilane was used instead of 15.0 parts by mass of vinyltriethoxysilane used in Production Example of toner particles 1. The formulation and conditions of the comparative toner particles 2 are shown in Table 3 and the physical properties thereof are shown in Table 9.

Production Example of Comparative Toner Particles 3

Comparative toner particles 3 were obtained as in Production Example of toner particles 1 except that 15.0 parts by mass of tetraethoxysilane was used instead of 15.0 parts by mass of vinyltriethoxysilane used in Production Example of toner particles 1. The formulation and conditions of the comparative toner particles 3 are shown in Table 3 and the physical properties thereof are shown in Table 9.

Production Example of Comparative Toner Particles 4

Comparative toner particles 4 were obtained as in Production Example of toner particles 1 except that 15.0 parts by mass of 3-methacryloxypropyltriethoxysilane was used instead of 15.0 parts by mass of vinyltriethoxysilane used in Production Example of toner particles 1. The formulation and conditions of the comparative toner particles 4 are shown in Table 3 and the physical properties thereof are shown in Table 9.

Production Example of Comparative Toner Particles 5

Comparative toner particles 5 were obtained as in Production Example of toner particles 1 except that 15.0 parts by mass of 3-methacryloxypropyltriethoxysilane was used instead of 15.0 parts by mass of vinyltriethoxysilane used in Production Example of toner particles 1. Moreover, instead of increasing the temperature inside the reactor to 85° C. and holding this temperature for 5 hours, the reactor was heated to 70° C. and held thereat for 10 hours. Furthermore, distillation was not performed. The formulation and conditions of the comparative toner particles 5 are shown in Table 3 and the physical properties thereof are shown in Table 9.

Production Example of Comparative Toner Particles 6

Comparative toner particles 6 were obtained as in Production Example of toner particles 1 except that 15.0 parts by mass of 3-methacryloxypropyltriethoxysilane was used instead of 15.0 parts by mass of vinyltriethoxysilane used in Production Example of toner particles 1. Moreover, instead of increasing the temperature inside the reactor to 70° C., the temperature was increased to 80° C., and instead of increasing the temperature inside the reactor to 85° C. and holding this temperature for 5 hours, the reactor was heated to 80° C. and held thereat for 10 hours. Furthermore, distillation was not performed. The formulation and conditions of the comparative toner particles 6 are shown in Table 3 and the physical properties thereof are shown in Table 9.

Production Example of Comparative Toner Particles 7

Comparative toner particles 7 were obtained as in Production Example of toner particles 1 except that 3.1 parts by mass of 3-methacryloxypropyltriethoxysilane was used instead of 15.0 parts by mass of vinyltriethoxysilane used in Production Example of toner particles 1. The formulation and conditions of the comparative toner particles 7 are shown in Table 3 and the physical properties thereof are shown in Table 9.

Production Example of Comparative Toner Particles 8

Comparative toner particles 8 were obtained as in Production Example of toner particles 1 except that 2.0 parts by mass of allyltriethoxysilane was used instead of 15.0 parts by mass of vinyltriethoxysilane used in Production Example of toner particles 1. The formulation and conditions of the comparative toner particles 8 are shown in Table 3 and the physical properties thereof are shown in Table 9.

Production Example of Comparative Toner Particles 9

Comparative toner particles 9 were obtained as in Production Example of toner particles 1 except that 1.5 parts by mass of allyltriethoxysilane was used instead of 15.0 parts by mass of vinyltriethoxysilane used in Production Example of toner particles 1. The formulation and conditions of the comparative toner particles 9 are shown in Table 3 and the physical properties thereof are shown in Table 9.

Production Example of Comparative Toner Particles 10

Comparative toner particles 10 were obtained as in Production Example of toner particles 1 except that 11.0 parts by mass of aminopropyltrimethoxysilane was used instead of 15.0 parts by mass of vinyltriethoxysilane used in Production Example of toner particles 1. The formulation and conditions of the comparative toner particles 10 are shown in Table 3 and the physical properties thereof are shown in Table 9.

Production Example of Comparative Toner Particles 11

Comparative toner particles 11 were obtained as in Production Example of toner particles 1 except that 0.0 parts by mass of vinyltriethoxysilane was used instead of 15.0 parts by mass of vinyltriethoxysilane used in Production Example of toner particles 1. The formulation and conditions of the comparative toner particles 11 are shown in Table 3 and the physical properties thereof are shown in Table 9.

Production Example of Comparative Toner Particles 12

To a four-necked flask equipped with a high-speed stirrer, TK-Homomixer, 900.0 parts by mass of ion exchange water and 95.0 parts by mass of polyvinyl alcohol were added. The resulting mixture was heated to 55° C. while being stirred at a rotation rate of 1300 rpm so as to prepare an aqueous dispersion medium.

Composition of Monomer Dispersion

The following materials were dispersed in an attritor for three hours:

styrene: 70.0 parts by mass n-butyl acrylate: 30.0 parts by mass carbon black: 10.0 parts by mass salicylic acid silane compound: 1.0 parts by mass
release agent (behenyl behenate, endothermic main peak temperature: 72.1° C.): 10.0 parts by mass To the resulting mixture, 14.0 parts by mass of a polymerization initiator, t-butyl peroxypivalate was added to prepare a monomer dispersion.

The monomer dispersion was placed in a dispersion medium in the four-necked flask described above and particles were formed while maintaining the above-described rotation rate for 10 minutes. Then polymerization was performed at 55° C. for 1 hour and then at 65° C. for 4 hours, and then at 80° C. for 5 hours under stirring at 50 rpm. After completion of the polymerization described above, the slurry was cooled and washed with purified water repeatedly to remove the dispersant. Washing and drying were performed to obtain black toner particles that serve as base bodies. The weight-average particle size of the black toner particles was 5.70 μm.

To a solution containing 2 parts by mass of isoamyl acetate and silicon compounds, namely, 3.5 parts by mass of tetraethoxysilane and 0.5 parts by mass of methyltriethoxysilane, 3.0 parts by mass of a 0.3 mass % sodium dodecylbenzenesulfonate solution was added. The resulting mixture was stirred with an ultrasonic homogenizer to prepare a mixed solution A containing isoamyl acetate, tetraethoxysilane, and methyltriethoxysilane.

To 30.0 parts by mass of a 0.3 mass % sodium dodecylbenzenesulfonate aqueous solution, 1.0 part by mass of the black toner particles serving as base bodies and the mixed solution A were added. To the resulting solution, 5.0 parts by mass of a 29.0 mass % $NH_4OH$ aqueous solution was added and stirring was performed at room temperature (25° C.) for 12 hours. The resulting product was washed with ethanol and then with purified water and particles were filtered and dried. As a result, comparative toner particles 12 were obtained. The weight-average particle size of the toner particles were 5.8 μm. The physical properties of the comparative toner particles 12 are shown in Table 9.

Production Example of Comparative Toner Particles 13

Comparative toner particles 13 were obtained as in Production Example of tone particles 26 except that the amount of the vinyltriethoxysilane used was changed from 15.0 parts by mass to 0.0 parts by mass. The physical properties of the comparative toner particles 13 are shown in Table 9.

Production Example of Comparative Toner Particles 14

Comparative toner particles 14 were obtained as in Production Example of tone particles 27 except that the amount of the vinyltriethoxysilane used was changed from 15.0 parts by mass to 0.0 parts by mass. The physical properties of the comparative toner particles 14 are shown in Table 9.

Observation of Surface Layers of Toner Particles 1

A TEM bright field image of the toner particles 1 was acquired by using a microscope, Tecnai TF20XT produced by FEI company at an acceleration voltage of 200 kV. Then an EF mapping image of a Si—K edge (99 eV) was acquired by a three window method by using an EELS detector, GIF Tridiem produced by Gatan Inc. The mapping image confirmed that the toner particles 1 were covered with surface layers that contained silicon. The thickness of the surface layers containing silicon was confirmed to be equal to the thickness determined by using a transmission electron microscope (TEM) as described above.

Observation of Surface Layers of Toner Particles 2 to 24

The surface layers of the toner particles 2 to 24 were observed as in the Observation of surface layers of toner particles 1 except that the toner particles 2 to 25 were observed instead of the toner particles 1. It was confirmed that, as with the toner particles 1, the toner particles 2 to 24 were covered with surface layers that contained silicon. The thickness of the surface layers containing silicon was confirmed to be equal to the thickness determined by using a transmission electron microscope (TEM) as described above.

Observation of Surface Layers of Comparative Toner Particles 1 to 14

The surface layers of the comparative toner particles 1 to 14 were observed as in the Observation of surface layers of toner particles 1 except that the comparative toner particles 1 to 14 were observed instead of the toner particles 1. It was confirmed that the comparative toner particles 1 to 14 had portions not covered with surface layers containing silicon.

Production Example of Toner 1

In a Henschel mixer (produced by Nippon Coke & Engineering Co., Ltd., formally known as Mitsui Mining Co., Ltd.), 100.0 parts by mass of the toner particles 1, 0.5 parts by mass of hydrophobic silica having a BET specific surface area of 210 $m^2/g$ and surfaces treated with 4 mass % of hexamethyldisilazane and 3 mass % of 100 cps silicone oil, and 0.2 parts by mass of aluminum oxide having a BET specific surface area of 70 $m^2/g$ were mixed to prepare a toner. This toner was used as a toner 1. The physical properties of the toner 1 are shown in Table 4.

Production Examples of Toners 2 to 24

Toners 2 to 24 were obtained as in Production Example of toner 1 except that the toner particles 2 to 24 were used instead of the toner particles 1 used in Production Example of toner 1. The physical properties of the toners 2 to 24 are shown in Tables 4 and 5.

Production Examples of Comparative Toners 1 to 14

Comparative toners 1 to 14 were obtained as in Production Example of toner 1 except that the comparative toner particles 1 to 14 were used instead of the toner particles 1 used in Production Example of toner 1. The physical properties of the comparative toners 1 to 14 are shown in Table 6.

Evaluation of Physical Properties of Toners 1 to 24 and Comparative Toners 1 to 14 after Washing A mixed solution of 1.0 part by mass of the toner 1, 100.0 parts by mass of ion exchange water, and 0.01 parts by mass of sodium dodecylbenzenesulfonate was ultrasonically dispersed for 5 minutes to conduct centrifugal separation. The upper 20% fraction of the filtrate was sampled. The filtrate was dried and the physical properties of the toner 1 after washing were measured. The physical properties of the toner 1 were the same as those before washing (Table 7).

The same operation was performed on the toners 2 to 24 and the comparative toners 1 to 14 and physical properties of the washed toners were measured. The same physical properties were exhibited as those before washing for all of the toners 2 to 24 and the comparative toners 1 to 14.

Example 1

The following evaluations were performed on the toner 1. The evaluation results are shown in Table 10.

Evaluation of Environmental Stability and Development Durability

Figure 3:
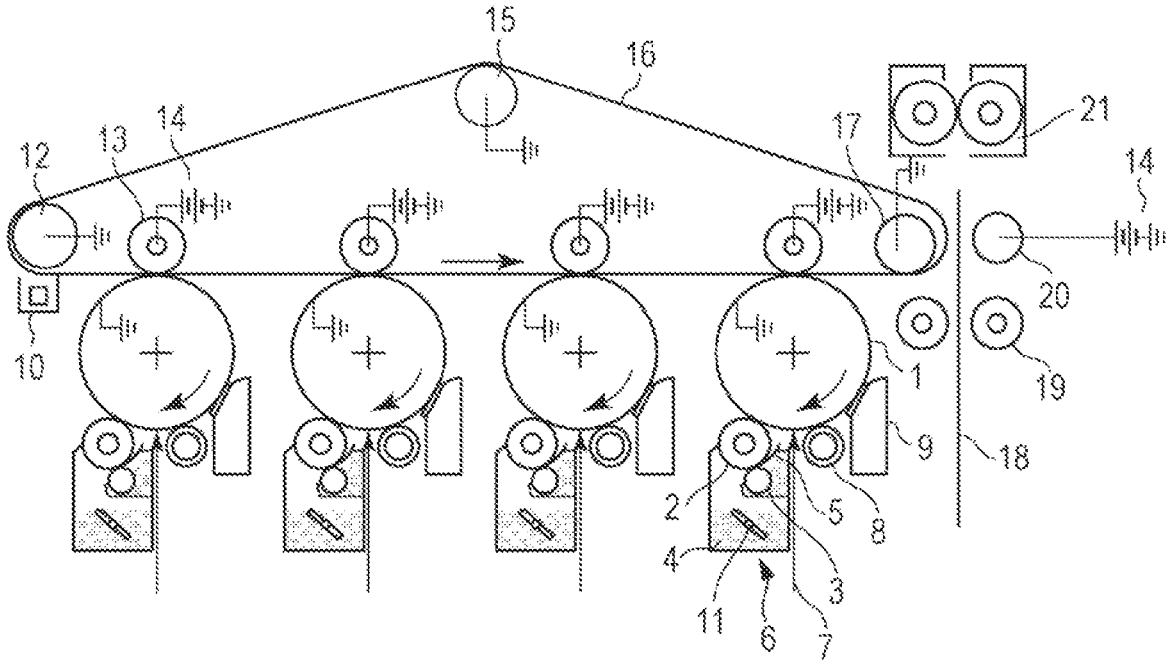
FIG. 3 is a schematic diagram of an image-forming apparatus used in examples.

Toner cartridges of a tandem-type laser beam printer HP Color Laser Jet Enterprise CP4525dn (produced by Hewlett Packard) having a structure illustrated in FIG. 3 were each loaded with 240 g of the toner 1. As shown in FIG. 3, the printer included a photosensitive member 1 to which a laser beam 7 is applied, a developing roller 2, a toner supplying roller 3, a toner 4, a regulating blade 5, a developing device 6, a charging device 8, a cleaning device 9, a charging device 10 for cleaning, a stirring blade 11, a drive roller 12, a transfer roller 13, a bias power supply 14, a tension roller 15, a transfer conveying belt 16, a driven roller 17, a feed roller 19 that feeds a paper sheet 18, an attraction roller 20, and a fixing device 21.

The toner cartridges for the printer were respectively left in a low temperature, low humidity (L/L) (10° C./15% RH) environment, a normal temperature, normal humidity (N/N) (25° C./50% RH) environment, and a super high temperature, high humidity environment (SHH) (32.5° C./90% RH) for 24 hours. Each toner cartridge after being left in the corresponding environment for 24 hours was attached to CP4525dn and an initial solid image (toner coverage: 0.40 mg/cm$^2$) was printed. Then an image with a 1.0% printing rate was printed on 20,000 sheets. After 20,000 sheets were printed out, a solid image was again output. The density of the solid image and extent of fogging before and after 20,000 sheets of printouts were made, soiling of parts after 20,000 sheets of printouts were made, and the cleaning performance were evaluated. For making printouts, 70 g/m$^2$ A4-size sheets of paper were used and printing was conducted in the transverse direction of the A4 sheet.

Evaluation of Image Density

A Macbeth densitometer (RD-914 produced by Macbeth) equipped with an SPI auxiliary filter was used to measure the image density of a fixed image portion of the initial solid image and the solid image after 20,000 sheets of printouts. The evaluation standard for the image density was as follows:

A: 1.45 or more
B: 1.40 or more and less than 1.45
C: 1.30 or more and less than 1.40
D: 1.25 or more and less than 1.30
E: 1.20 or more and less than 1.25
F: less than 1.20

Evaluation of Fogging

The whiteness degree of background portions of an initial image with 0% printing rate and an image with 0% printing rate after 20,000 sheets of printouts were made was measured with a reflectometer (produced by Tokyo Denshoku Co., Ltd.). The observed values were compared with the whiteness degree of the transfer paper so as calculate the difference and the fogging density (%) was determined from the difference. Fogging was evaluated from the results of the fogging density based on the following standard:

A: less than 1.0%
B: 1.0% or more and less than 1.5%
C: 1.5% or more and less than 2.0%
D: 2.0% or more and less than 2.5%
E: 2.5% or more and less than 3.0%
F: 3.0% or more Evaluation of Soiling of Parts After 20,000 sheets of printouts were made, an image in which the upper half portion is a halftone image (toner coverage: 0.25 mg/cm$^2$) and the lower half portion is a solid image (toner coverage: 0.40 mg/cm$^2$) was printed out and evaluated according to the following standard.

A: Vertical streaks that extend in the sheet feeding direction are found on none of the developing roller, the halftone image portion, and the solid image portion.

B: One or two fine streaks extending in a circumferential direction are found on two ends of the developing roller, but vertical streaks that extend in the sheet feeding direction are found on none of the halftone image portion and the solid image portion.

C: Three to five fine streaks extending in a circumferential direction are found on two ends of the developing roller and few vertical streaks that extend in the sheet feeding direction are found on the halftone image portion and the solid image portion. However, these streaks can be erased by image processing.

D: Six to twenty fine streaks extending in a circumferential direction are found on two ends of the developing roller and several fine streaks are also found on the halftone image portion and the solid image portion. These streaks cannot be erased by image processing.

E: Twenty-one or more streaks are found on the developing roller and the halftone mage portion and these streaks cannot be erased by image processing.

Measurement of Triboelectric Charge Amount of the Toner

The triboelectric charge amount of the toner was determined by the following method. First, toners and standard carriers for a negatively chargeable toner (trade name: N-01 produced by The Imaging Society of Japan) were left standing for 24 hours in a low temperature, low humidity (LL) (10° C./15% RH) environment, a normal temperature, normal humidity (NN) (25° C./50% RH) environment, and a super high temperature, high humidity (SHH) (32.5° C./90% RH) environment. The toners and the standard carriers after being left in the above-described environment were mixed with each other by using a turbula mixer for 120 seconds in the environment so that the toner content was 5.0 mass %. As a result, a two-component developer was obtained. Within one minute after completion of mixing of the two-component developer, the two-component developer was placed in a metal container having a bottom equipped with a conductive screen having an aperture of 20 μm in a normal temperature, normal humidity (25° C./50% RH) environment. The container was suctioned with a suction machine. The difference in mass between before and after suction and the potential accumulated in a capacitor connected to the container was measured. The suction pressure was 4.0 kPa. The triboelectric charge amount of the toner was calculated by using the following equation based on the difference in mass between before and after suction, the potential accumulated, and the capacity of the capacitor.

The standard carrier for a negatively chargeable toner used for measurement (trade name: N-01 produced by The Imaging Society of Japan) was screened with a 250 mesh in advance and the undersize was used.

$$Q(C/kg)=C\times V/(W1-W2)$$

Q: triboelectric charge amount of charge control resin and toner
C (μT): capacity of capacitor
V (volt): potential accumulated in capacitor
W1−W2 (g): difference in mass between before and after suction Evaluation of Cleaning Performance The extent of the toner escaping the cleaning blade observed when a solid image with a 5% printing rate was output in the respective environments after making 20,000 sheets of output was examined to evaluate the cleaning performance. After completion of the evaluation, the cartridges were left standing in a 0° C. environment for 24 hours and then the same evaluation was conducted. The evaluation standard was as follows:

A: No toner escaped the blade.
B: Some toner escaped the blade but the output image was not affected.
C: Some toner escaped the blade such that the charging member could be soiled but the output image was not affected.
D: Toner escaped the blade and the output image was affected.
E: Significant amounts of toner escaped the blade and the output image was significantly affected.

Evaluation of Low-Temperature Fixability (Low-Temperature Offset End Temperature)

The fixing unit of the laser beam printer CP4525dn produced by Hewlett Packard was modified so that the fixing temperature could be adjusted. The modified CP4525dn was used to heat-press an unfixed toner image having a toner coverage of 0.4 mg/cm$^2$ to an image-receiving sheet in an oil-less manner at a process speed of 230 mm/sec so as to form a fixed image on the image-receiving sheet.

The fixability was evaluated in terms of low-temperature offset end temperature at which the rate of decrease in density between before and after ten times of rubbing of a fixed image with Kimwipes (S-200 produced by NIPPON PAPER CRECIA Co., LTD.) under a 75 g/cm$^2$ load was less than 5%. Evaluation was conducted at normal temperature and normal humidity (25° C./50% RH).

Evaluation of Storage Stability

Evaluation of Storage Property

In a 100 mL glass jar, 10 g of the toner 1 was placed and left at 55° C. and a humidity of 20% for 15 days. The toner was then observed with naked eye.

A: No changes were observed.

B: Some aggregates were observed but they were loose.

C: Aggregates that were not loose were observed.

D: No fluidity was observed.

E: Clear caking occurred.

Evaluation of Long-Term Storage Property

In a 100 mL glass jar, about 10 g of a toner was placed and left at 45° C. and a humidity of 95% for three months. The toner was then observed with naked eye.

A: No changes were observed.

B: Some aggregates were observed but they were loose.

C: Aggregates that were not loose were observed.

D: No fluidity was observed.

E: Clear caking occurred.

Examples 2 to 22

Evaluation was conducted as in Example 1 except that the toner 1 used in Example 1 was changed to the toners 2 to 22. The results are shown in Tables 10 and 11.

Comparative Examples 1 to 14

Evaluation was conducted as in Example 1 except that the toner 1 used in Example 1 was changed to the comparative toners 1 to 14. The results are shown in Table 12.

In the tables below, pbm denotes parts by mass.

TABLE 1

| | | | Toner particles | | | | | | | | | | | |
|---|---|---|---|---|---|---|---|---|---|---|---|---|---|---|
| | | | Toner particles 1 | Toner particles 2 | Toner particles 3 | Toner particles 4 | Toner particles 5 | Toner particles 6 | Toner particles 7 | Toner particles 8 | Toner particles 9 | Toner particles 10 | Toner particles 11 | Toner particles 12 |
| Monomer | Styrene | pbm | 70.0 | 70.0 | 70.0 | 70.0 | 70.0 | 70.0 | 70.0 | 70.0 | 70.0 | 70.0 | 70.0 | 70.0 |
| | n-Butyl acrylate | pbm | 30.0 | 30.0 | 0.0 | 29.0 | 29.0 | 30.0 | 30.0 | 30.0 | 30.0 | 30.0 | 30.0 | 30.0 |
| | Butyl methacrylate | pbm | 0.0 | 0.0 | 30.0 | 0.0 | 0.0 | 0.0 | 0.0 | 0.0 | 0.0 | 0.0 | 0.0 | 0.0 |
| | Acrylic acid | pbm | 0.0 | 0.0 | 0.0 | 1.0 | 0.0 | 0.0 | 0.0 | 0.0 | 0.0 | 0.0 | 0.0 | 0.0 |
| | Behenyl acrylate | pbm | 0.0 | 0.0 | 0.0 | 0.0 | 1.0 | 0.0 | 0.0 | 0.0 | 0.0 | 0.0 | 0.0 | 0.0 |
| | Divinylbenzene | pbm | 0.1 | 0.1 | 0.1 | 0.1 | 0.1 | 0.1 | 0.1 | 0.1 | 0.1 | 0.1 | 0.1 | 0.1 |
| | Silane | Silane 1 | Vinyltrieth-oxysilane | Allyltrieth-oxysilane | Vinyltrieth-oxysilane | Vinyltrieth-oxysilane | Vinyltrieth-oxysilane | Vinyltri-methoxy-silane | Vinyltriis-opropoxy-silane | Vinyldieth-oxychloro-silane | Vinyltrieth-oxysilane | Vinyltrieth-oxysilane | Vinyltrieth-oxysilane | Vinyltrieth-oxysilane |
| | | Amount of silane 1 (pbm) | 15.0 | 15.0 | 15.0 | 15.0 | 15.0 | 15.0 | 15.0 | 15.0 | 50.0 | 30.0 | 10.5 | 9.5 |
| Polyester-based resin | | Type | (1) | (1) | (1) | (1) | (1) | (1) | (1) | (1) | (1) | (1) | (1) | (1) |
| | | pbm | 5.0 | 5.0 | 5.0 | 5.0 | 5.0 | 5.0 | 5.0 | 5.0 | 5.0 | 5.0 | 5.0 | 5.0 |
| Release agent | | Type | Behenyl behenate | Behenyl behenate | Behenyl behenate | Behenyl behenate | Behenyl behenate | Behenyl behenate | Behenyl behenate | Behenyl behenate | Behenyl behenate | Behenyl behenate | Behenyl behenate | Behenyl behenate |
| | | pbm | 10.0 | 10.0 | 10.0 | 10.0 | 10.0 | 10.0 | 10.0 | 10.0 | 10.0 | 10.0 | 10.0 | 10.0 |
| | | Melting point (° C.) | 72.1 | 72.1 | 72.1 | 72.1 | 72.1 | 72.1 | 72.1 | 72.1 | 72.1 | 72.1 | 72.1 | 72.1 |
| | | Heat absorption (J/g) | 210.3 | 210.3 | 210.3 | 210.3 | 210.3 | 210.3 | 210.3 | 210.3 | 210.3 | 210.3 | 210.3 | 210.3 |
| Colorant | | Colorant type | Copper phthalo-cyanine | Copper phthalo-cyanine | Copper phthalo-cyanine | Copper phthalo-cyanine | Copper phthalo-cyanine | Copper phthalo-cyanine | Copper phthalo-cyanine | Copper phthalo-cyanine | Copper phthalo-cyanine | Copper phthalo-cyanine | Copper phthalo-cyanine | Copper phthalo-cyanine |
| | | pbm | 6.5 | 6.5 | 6.5 | 6.5 | 6.5 | 6.5 | 6.5 | 6.5 | 6.5 | 6.5 | 6.5 | 6.5 |
| Negative charge control agent | Charge control resin 1 | pbm | 0.5 | 0.5 | 0.5 | 0.5 | 0.5 | 0.5 | 0.5 | 0.5 | 0.5 | 0.5 | 0.5 | 0.5 |
| | Charge control agent 1 | pbm | 0.5 | 0.5 | 0.5 | 0.5 | 0.5 | 0.5 | 0.5 | 0.5 | 0.5 | 0.5 | 0.5 | 0.5 |

TABLE 1-continued

| | | | Toner particles | | | | | | | | | | | |
|---|---|---|---|---|---|---|---|---|---|---|---|---|---|---|
| | | | Toner particles 1 | Toner particles 2 | Toner particles 3 | Toner particles 4 | Toner particles 5 | Toner particles 6 | Toner particles 7 | Toner particles 8 | Toner particles 9 | Toner particles 10 | Toner particles 11 | Toner particles 12 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate |
| | Amount added | pbm | 14.0 | 14.0 | 14.0 | 14.0 | 14.0 | 14.0 | 14.0 | 14.0 | 14.0 | 14.0 | 14.0 | 14.0 |
| Polymerization conditions | Reaction 1 | Temperature | 70 | 70 | 70 | 70 | 70 | 70 | 70 | 70 | 70 | 70 | 70 | 70 |
| | | Holding time (hour) | 5 h | 5 h | 5 h | 5 h | 5 h | 5 h | 5 h | 5 h | 5 h | 5 h | 5 h | 5 h |
| | | pH | 5.0 | 5.0 | 5.0 | 5.0 | 5.0 | 5.0 | 5.0 | 5.0 | 5.0 | 5.0 | 5.0 | 5.0 |
| | Reaction 2 | Temperature | 85 | 85 | 85 | 85 | 85 | 85 | 85 | 85 | 85 | 85 | 85 | 85 |
| | | Holding time (hour) | 5 h | 5 h | 5 h | 5 h | 5 h | 5 h | 5 h | 5 h | 5 h | 5 h | 5 h | 5 h |
| | | pH | 5.0 | 5.0 | 5.0 | 5.0 | 5.0 | 5.0 | 5.0 | 5.0 | 5.0 | 5.0 | 5.0 | 5.0 |
| | Reaction 3 | Temperature | 100 | 100 | 100 | 100 | 100 | 100 | 100 | 100 | 100 | 100 | 100 | 100 |
| | | Holding time (hour) | 5 h | 5 h | 5 h | 5 h | 5 h | 5 h | 5 h | 5 h | 5 h | 5 h | 5 h | 5 h |
| | | pH | 5.0 | 5.0 | 5.0 | 5.0 | 5.0 | 5.0 | 5.0 | 5.0 | 5.0 | 5.0 | 5.0 | 5.0 |

TABLE 2

| | | | Toner particles | | | | | | | | | | | |
|---|---|---|---|---|---|---|---|---|---|---|---|---|---|---|
| | | | Toner particles 13 | Toner particles 14 | Toner particles 15 | Toner particles 16 | Toner particles 17 | Toner particles 18 | Toner particles 19 | Toner particles 20 | Toner particles 21 | Toner particles 22 | Toner particles 23 | Toner particles 24 |
| Monomer | Styrene | pbm | 70.0 | 70.0 | 70.0 | 70.0 | Described in the specification | Described in the specification | Described in the specification | Described in the specification | 60.0 | 70.0 | 70.0 | 70.0 |
| | n-Butyl acrylate | pbm | 30.0 | 30.0 | 30.0 | 30.0 | | | | | 40.0 | 30.0 | 30.0 | 30.0 |
| | Butyl methacrylate | pbm | 0.0 | 0.0 | 30.0 | 0.0 | | | | | 0.0 | 0.0 | 0.0 | 0.0 |
| | Acrylic acid | pbm | 0.0 | 0.0 | 0.0 | 1.0 | | | | | 0.0 | 0.0 | 0.0 | 0.0 |
| | Behenyl acrylate | pbm | 0.0 | 0.0 | 0.0 | 0.0 | | | | | 0.0 | 0.0 | 0.0 | 0.0 |
| | Divinylbenzene | pbm | 0.1 | 0.1 | 0.1 | 0.1 | | | | | 0.1 | 0.1 | 0.1 | 0.1 |
| | Silane | Silane 1 | Vinyltrieth-oxysilane | Vinyltrieth-oxysilane | Allyltrieth-oxysilane | Allyltrieth-oxysilane | | | | | Vinyltrieth-oxysilane | Vinyltrieth-oxysilane | Vinyltrieth-oxysilane | Vinyltrieth-oxysilane |
| | | Amount of silane 1 (pbm) | 5.0 | 4.0 | 5.0 | 4.0 | | | | | 15.0 | 15.0 | 15.0 | 15.0 |
| Polyester-based resin | | Type | (1) | (1) | (1) | (1) | | | | | (1) | (1) | (1) | (1) |
| | | pbm | 5.0 | 5.0 | 5.0 | 5.0 | | | | | 5.0 | 5.0 | 5.0 | 5.0 |
| Release agent | | Type | Behenyl behenate | Behenyl behenate | Behenyl behenate | Behenyl behenate | | | | | Behenyl behenate | Behenyl behenate | Behenyl behenate | Behenyl behenate |
| | | pbm | 10.0 | 10.0 | 10.0 | 10.0 | | | | | 10.0 | 10.0 | 10.0 | 10.0 |
| | | Melting point (° C.) | 72.1 | 72.1 | 72.1 | 72.1 | | | | | 72.1 | 72.1 | 72.1 | 72.1 |
| | | Heat absorption (J/g) | 210.3 | 210.3 | 210.3 | 210.3 | | | | | 210.3 | 210.3 | 210.3 | 210.3 |
| Colorant | | Colorant type | Copper phthalo-cyanine | Copper phthalo-cyanine | Copper phthalo-cyanine | Copper phthalo-cyanine | | | | | Copper phthalo-cyanine | P.Y.155 | P.R.122 | Carbon black |
| | | pbm | 6.5 | 6.5 | 6.5 | 6.5 | | | | | 6.5 | 6.0 | 8.0 | 10.0 |
| Negative charge control agent | Charge control resin 1 | pbm | 0.5 | 0.5 | 0.5 | 0.5 | | | | | 0.5 | 0.5 | 0.5 | 0.5 |
| | Charge control agent 1 | pbm | 0.5 | 0.5 | 0.5 | 0.5 | | | | | 0.5 | 0.5 | 0.5 | 0.5 |

TABLE 2-continued

| | | | Toner particles | | | | | | | | | | | |
|---|---|---|---|---|---|---|---|---|---|---|---|---|---|---|
| | | | Toner particles 13 | Toner particles 14 | Toner particles 15 | Toner particles 16 | Toner particles 17 | Toner particles 18 | Toner particles 19 | Toner particles 20 | Toner particles 21 | Toner particles 22 | Toner particles 23 | Toner particles 24 |
| Oil-soluble initiator | Type | | t-Butyl peroxy-pivalate | t-Butyl peroxy-pivalate | t-Butyl peroxy-pivalate | t-Butyl peroxy-pivalate | | | | | t-Butyl peroxy-pivalate | t-Butyl peroxy-pivalate | t-Butyl peroxy-pivalate | t-Butyl peroxy-pivalate |
| | Amount added | pbm | 14.0 | 14.0 | 14.0 | 14.0 | | | | | 14.0 | 14.0 | 14.0 | 14.0 |
| Polymer-ization conditions | Reaction 1 | Temperature | 70 | 70 | 70 | 70 | | | | | 70 | 70 | 70 | 70 |
| | | Holding time (hour) | 5 h | 5 h | 5 h | 5 h | | | | | 5 h | 5 h | 5 h | 5 h |
| | | pH | 5.0 | 5.0 | 5.0 | 5.0 | | | | | 5.0 | 5.0 | 5.0 | 5.0 |
| | Reaction 2 | Temperature | 85 | 85 | 85 | 85 | | | | | 85 | 85 | 85 | 85 |
| | | Holding time (hour) | 5 h | 5 h | 5 h | 5 h | | | | | 5 h | 5 h | 5 h | 5 h |
| | | pH | 5.0 | 5.0 | 5.0 | 5.0 | | | | | 5.0 | 5.0 | 5.0 | 5.0 |
| | Reaction 3 | Temperature | 100 | 100 | 100 | 100 | | | | | 100 | 100 | 100 | 100 |
| | | Holding time (hour) | 5 h | 5 h | 5 h | 5 h | | | | | 5 h | 5 h | 5 h | 5 h |
| | | pH | 5.0 | 5.0 | 5.0 | 5.0 | | | | | 5.0 | 5.0 | 5.0 | 5.0 |

TABLE 3

| | | | Toner particle | | | | | | | | | | | | | |
|---|---|---|---|---|---|---|---|---|---|---|---|---|---|---|---|---|
| | | | Comparative toner particle 1 | Comparative toner particle 2 | Comparative toner particle 3 | Comparative toner particle 4 | Comparative toner particle 5 | Comparative toner particle 6 | Comparative toner particle 7 | Comparative toner particle 8 | Comparative toner particle 9 | Comparative toner particle 10 | Comparative toner particle 11 | Comparative toner particle 12 | Comparative toner particle 13 | Comparative toner particle 14 |
| Monomer | Styrene | pbm | 70.0 | 70.0 | 70.0 | 70.0 | 70.0 | 70.0 | 70.0 | 70.0 | 70.0 | 70.0 | 70.0 | Described in the specification | Described in the specification | Described in the specification |
| | n-Butyl acrylate | pbm | 30.0 | 30.0 | 30.0 | 30.0 | 30.0 | 30.0 | 30.0 | 30.0 | 30.0 | 30.0 | 30.0 | | | |
| | Butyl methacrylate | pbm | 0.0 | 0.0 | 0.0 | 0.0 | 0.0 | 0.0 | 0.0 | 0.0 | 0.0 | 0.0 | 0.0 | | | |
| | Acrylic acid | pbm | 0.0 | 0.0 | 0.0 | 0.0 | 0.0 | 0.0 | 0.0 | 0.0 | 0.0 | 0.0 | 0.0 | | | |
| | Behenyl acrylate | pbm | 0.0 | 0.0 | 0.0 | 0.0 | 0.0 | 0.0 | 0.0 | 0.0 | 0.0 | 0.0 | 0.0 | | | |
| | Divinylbenzene | pbm | 0.1 | 0.1 | 0.1 | 0.1 | 0.1 | 0.1 | 0.1 | 0.1 | 0.1 | 0.1 | 0.1 | | | |
| | Silane | Silane 1 | Vinyltriethoxysilane | Vinyltriethoxysilane | Tetraethoxysilane | 3-Methacryloxypropyltriethoxysilane | 3-Methacryloxypropyltriethoxysilane | 3-Methacryloxypropyltriethoxysilane | 3-Methacryloxypropyltriethoxysilane | Allyltriethoxysilane | Allyltriethoxysilane | Aminopropyltrimethoxysilane | — | | | |
| | | Amount of silane 1 (pbm) | 2.0 | 1.5 | 15.0 | 15.0 | 15.0 | 15.0 | 3.1 | 2.0 | 1.5 | 11.0 | 0.0 | | | |
| Polyester-based resin | | Type | (1) | (1) | (1) | (1) | (1) | (1) | (1) | (1) | (1) | (1) | (1) | | | |
| | | pbm | 5.0 | 5.0 | 5.0 | 5.0 | 5.0 | 5.0 | 5.0 | 5.0 | 5.0 | 5.0 | 5.0 | | | |
| Release agent | | Type | Behenyl behenate | Behenyl behenate | Behenyl behenate | Behenyl behenate | Behenyl behenate | Behenyl behenate | Behenyl behenate | Behenyl behenate | Behenyl behenate | Behenyl behenate | Behenyl behenate | | | |
| | | pbm | 10.0 | 10.0 | 10.0 | 10.0 | 10.0 | 10.0 | 10.0 | 10.0 | 10.0 | 10.0 | 10.0 | | | |
| | | Melting point (° C.) | 72.1 | 72.1 | 72.1 | 72.1 | 72.1 | 72.1 | 72.1 | 72.1 | 72.1 | 72.1 | 72.1 | | | |
| | | Heat absorption (J/g) | 210.3 | 210.3 | 210.3 | 210.3 | 210.3 | 210.3 | 210.3 | 210.3 | 210.3 | 210.3 | 210.3 | | | |
| Colorant | | Colorant type | Copper phthalocyanine | Copper phthalocyanine | Copper phthalocyanine | Copper phthalocyanine | Copper phthalocyanine | Copper phthalocyanine | Copper phthalocyanine | Copper phthalocyanine | Copper phthalocyanine | Copper phthalocyanine | Copper phthalocyanine | | | |
| | | pbm | 6.5 | 6.5 | 6.5 | 6.5 | 6.5 | 6.5 | 6.5 | 6.5 | 6.5 | 6.5 | 6.5 | | | |
| Negative charge control agent | Charge control resin 1 | pbm | 0.5 | 0.5 | 0.5 | 0.5 | 0.5 | 0.5 | 0.5 | 0.5 | 0.5 | 0.5 | 0.5 | | | |
| | Charge control agent 1 | pbm | 0.5 | 0.5 | 0.5 | 0.5 | 0.5 | 0.5 | 0.5 | 0.5 | 0.5 | 0.5 | 0.5 | | | |

TABLE 3-continued

| | | | Toner particle | | | | | | | | | | | | | |
|---|---|---|---|---|---|---|---|---|---|---|---|---|---|---|---|---|
| | | | Comparative toner particle 1 | Comparative toner particle 2 | Comparative toner particle 3 | Comparative toner particle 4 | Comparative toner particle 5 | Comparative toner particle 6 | Comparative toner particle 7 | Comparative toner particle 8 | Comparative toner particle 9 | Comparative toner particle 10 | Comparative toner particle 11 | Comparative toner particle 12 | Comparative toner particle 13 | Comparative toner particle 14 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | | | |
| | Amount added | pbm | 14.0 | 14.0 | 14.0 | 14.0 | 14.0 | 14.0 | 14.0 | 14.0 | 14.0 | 14.0 | 14.0 | | | |
| Polymerization conditions | Reaction 1 | Temperature | 70 | 70 | 70 | 70 | 70 | 80 | 70 | 70 | 70 | 70 | 70 | | | |
| | | Holding time (hour) | 5 h | 5 h | 5 h | 5 h | 5 h | 5 h | 5 h | 5 h | 5 h | 5 h | 5 h | | | |
| | | pH | 5.1 | 5.1 | 5.1 | 5.1 | 5.1 | 5.1 | 5.1 | 5.1 | 5.1 | 5.1 | 5.1 | | | |
| | Reaction 2 | Temperature | 85 | 85 | 85 | 85 | 70 | 80 | 85 | 85 | 70 | 85 | 85 | | | |
| | | Holding time (hour) | 5 h | 5 h | 5 h | 5 h | 10 h | 10 h | 5 h | 5 h | 5 h | 5 h | 5 h | | | |
| | | pH | 7.0 | 7.0 | 7.0 | 7.0 | 7.0 | 7.0 | 7.0 | 7.0 | 7.0 | 7.0 | 7.0 | | | |
| | Reaction 3 | Temperature | 100 | 100 | 100 | 100 | — | — | 100 | 100 | 70 | 100 | 100 | | | |
| | | Holding time (hour) | 5 h | 5 h | 5 h | 5 h | — | — | 5 h | 5 h | 5 h | 5 h | 5 h | | | |
| | | pH | 7.0 | 7.0 | 7.0 | 7.0 | — | — | 7.0 | 7.0 | 7.0 | 7.0 | 7.0 | | | |

TABLE 4

| | | Toner | | | | | |
|---|---|---|---|---|---|---|---|
| | | Toner 1 | Toner 2 | Toner 3 | Toner 4 | Toner 5 | Toner 6 |
| Physical properties | THF insoluble content (%) | 27.4 | 28.1 | 27.5 | 27.6 | 27.5 | 27.6 |
| | Average circularity | 0.983 | 0.983 | 0.983 | 0.983 | 0.983 | 0.983 |
| | Mode circularity | 1.00 | 1.00 | 1.00 | 1.00 | 1.00 | 1.00 |
| | Weight-average molecular weight | 33200 | 33200 | 33300 | 33400 | 33400 | 34000 |
| | Weight-average molecular weight/ Number-average molecular weight | 11.4 | 13.7 | 11.8 | 11.8 | 11.7 | 11.3 |
| | Equivalent circle diameter determined from cross section of toner particle Dtemav. (μm) | 5.6 | 5.4 | 5.6 | 5.6 | 5.5 | 5.6 |
| | Weight-average particle size (μm) | 5.6 | 5.4 | 5.6 | 5.6 | 5.6 | 5.6 |
| | Number-average particle size (μm) | 5.2 | 5.1 | 5.2 | 5.2 | 5.2 | 5.2 |
| | Endothermic main peak temperature (° C.) | 70.4 | 70.3 | 70.3 | 70.3 | 70.3 | 70.3 |
| | Integrated calorific value (J/g) | 19.3 | 19.7 | 19.5 | 19.6 | 19.6 | 19.4 |
| | Glass transition temperature (° C.) | 47.6 | 49.6 | 48.5 | 48.9 | 49.0 | 49.1 |
| | 80° C. viscosity (Pa · S) | 19000 | 19000 | 19000 | 19000 | 19200 | 19800 |
| | Shape factor SF-2 | 180 | 183 | 178 | 190 | 168 | 178 |

| | | Toner | | | | | |
|---|---|---|---|---|---|---|---|
| | | Toner 7 | Toner 8 | Toner 9 | Toner 10 | Toner 11 | Toner 12 |
| Physical properties | THF insoluble content (%) | 27.3 | 27.5 | 48.2 | 43.5 | 22 | 21.5 |
| | Average circularity | 0.982 | 0.983 | 0.981 | 0.983 | 0.974 | 0.974 |
| | Mode circularity | 1.00 | 1.00 | 1.00 | 1.00 | 1.00 | 1.00 |
| | Weight-average molecular weight | 34000 | 34100 | 34100 | 34000 | 33400 | 33500 |
| | Weight-average molecular weight/ Number-average molecular weight | 11.5 | 11.7 | 11.5 | 11.3 | 11.5 | 11.5 |
| | Equivalent circle diameter determined from cross section of toner particle Dtemav. (μm) | 5.5 | 5.4 | 5.6 | 5.6 | 5.5 | 5.5 |
| | Weight-average particle size (μm) | 5.6 | 5.6 | 5.7 | 5.6 | 5.6 | 5.6 |
| | Number-average particle size (μm) | 5.2 | 5.2 | 5.3 | 5.2 | 5.2 | 5.2 |
| | Endothermic main peak temperature (° C.) | 70.3 | 70.3 | 70.3 | 70.3 | 70.1 | 70.5 |
| | Integrated calorific value (J/g) | 19.3 | 19.3 | 19.3 | 19.4 | 19.1 | 19.0 |
| | Glass transition temperature (° C.) | 49.2 | 50.1 | 50.2 | 49.1 | 50.2 | 50.2 |
| | 80° C. viscosity (Pa · S) | 18500 | 19000 | 19800 | 19800 | 18800 | 19600 |
| | Shape factor SF-2 | 195 | 165 | 215 | 196 | 177 | 176 |

TABLE 5

| | | Toner | | | | | |
|---|---|---|---|---|---|---|---|
| | | Toner 13 | Toner 14 | Toner 15 | Toner 16 | Toner 17 | Toner 18 |
| Physical properties | THF insoluble content (%) | 17.3 | 16.8 | 17.9 | 17 | 27.5 | 27.6 |
| | Average circularity | 0.974 | 0.974 | 0.972 | 0.972 | 0.973 | 0.974 |
| | Mode circularity | 1.00 | 1.00 | 1.00 | 1.00 | 0.90 | 1.00 |
| | Weight-average molecular weight | 34200 | 34100 | 34700 | 34600 | 62000 | 24600 |
| | Weight-average molecular weight/ Number-average molecular weight | 11.2 | 11.2 | 11.0 | 11.2 | 23.4 | 17.4 |
| | Equivalent circle diameter determined from cross section of toner particle Dtemav. (μm) | 5.4 | 5.4 | 5.4 | 5.5 | 5.6 | 5.5 |
| | Weight-average particle size (μm) | 5.6 | 5.6 | 5.6 | 5.7 | 5.6 | 5.5 |
| | Number-average particle size (μm) | 5.2 | 5.2 | 5.2 | 5.2 | 5.2 | 5.2 |
| | Endothermic main peak temperature (° C.) | 70.3 | 70.4 | 70.1 | 70.6 | 70.4 | 70.4 |
| | Integrated calorific value (J/g) | 19.2 | 18.9 | 19.4 | 19.4 | 19.3 | 19.1 |
| | Glass transition temperature (° C.) | 50.4 | 50.4 | 50.3 | 50.3 | 51.6 | 51.2 |
| | 80° C. viscosity (Pa · S) | 18500 | 19000 | 18600 | 18700 | 19300 | 17400 |
| | Shape factor SF-2 | 169 | 158 | 167 | 165 | 190 | 192 |

| | | Toner | | | | | |
|---|---|---|---|---|---|---|---|
| | | Toner 19 | Toner 20 | Toner 21 | Toner 22 | Toner 23 | Toner 24 |
| Physical properties | THF insoluble content (%) | 27.4 | 27.4 | 27.4 | 27.3 | 27.4 | 27.1 |
| | Average circularity | 0.972 | 0.982 | 0.983 | 0.983 | 0.983 | 0.983 |
| | Mode circularity | 1.00 | 1.00 | 1.00 | 1.00 | 1.00 | 1.00 |

TABLE 5-continued

| | | | | | | |
|---|---|---|---|---|---|---|
| Weight-average molecular weight | 40800 | 61000 | 32700 | 33000 | 33100 | 33200 |
| Weight-average molecular weight/ Number-average molecular weight | 19.4 | 21.4 | 11.1 | 11.2 | 11.3 | 11.4 |
| Equivalent circle diameter determined from cross section of toner particle Dtemav. (μm) | 5.6 | 5.7 | 5.6 | 5.6 | 5.6 | 5.5 |
| Weight-average particle size (μm) | 5.5 | 5.6 | 5.5 | 5.6 | 5.5 | 5.6 |
| Number-average particle size (μm) | 5.2 | 5.1 | 5.2 | 5.2 | 5.2 | 5.2 |
| Endothermic main peak temperature (° C.) | 70.5 | 70.4 | 70.0 | 70.2 | 70.5 | 70.4 |
| Integrated calorific value (J/g) | 19.2 | 19.3 | 19.0 | 19.5 | 19.8 | 19.1 |
| Glass transition temperature (° C.) | 51.4 | 51.6 | 40.3 | 48.1 | 48.5 | 47.8 |
| 80° C. viscosity (Pa · S) | 16800 | 18500 | 18800 | 19000 | 18900 | 19100 |
| Shape factor SF-2 | 194 | 191 | 183 | 181 | 180 | 184 |

TABLE 6

| | | Toner | | | | | | |
|---|---|---|---|---|---|---|---|---|
| | | Comparative toner 1 | Comparative toner 2 | Comparative toner 3 | Comparative toner 4 | Comparative toner 5 | Comparative toner 6 | Comparative toner 7 |
| Physical properties | THF insoluble content (%) | 14.1 | 13.8 | 12.1 | 34.3 | 34.4 | 34.4 | 15.8 |
| | Average circularity | 0.978 | 0.981 | 0.982 | 0.982 | 0.982 | 0.988 | 0.982 |
| | Mode circularity | 1.00 | 1.00 | 1.00 | 1.00 | 1.00 | 1.00 | 1.00 |
| | Weight-average molecular weight | 34500 | 34200 | 34100 | 37200 | 37400 | 28400 | 35200 |
| | Weight-average molecular weight/ Number-average molecular weight | 11.4 | 10.8 | 10.9 | 11.5 | 11.8 | 9.8 | 10.8 |
| | Equivalent circle diameter determined from cross section of toner particle Dtemav. (μm) | 5.6 | 5.6 | 5.5 | 5.7 | 5.6 | 5.6 | 5.7 |
| | Weight-average particle size (μm) | 5.7 | 5.6 | 5.6 | 5.6 | 5.6 | 5.6 | 5.6 |
| | Number-average particle size (μm) | 5.2 | 5.3 | 5.3 | 5.2 | 5.1 | 5.2 | 5.8 |
| | Endothermic main peak temperature (° C.) | 70.6 | 70.1 | 70.8 | 70.6 | 70.4 | 70.3 | 70.5 |
| | Integrated calorific value (J/g) | 19.2 | 19.4 | 19.8 | 19.4 | 19.3 | 19.4 | 19.8 |
| | Glass transition temperature (° C.) | 50.1 | 50.3 | 49.9 | 50.9 | 50.4 | 50.6 | 50.1 |
| | 80° C. viscosity (Pa · S) | 19200 | 19400 | 19200 | 19500 | 19100 | 16000 | 19400 |
| | Shape factor SF-2 | 148 | 138 | 125 | 130 | 133 | 131 | 129 |

| | | Toner | | | | | | |
|---|---|---|---|---|---|---|---|---|
| | | Comparative toner 8 | Comparative toner 9 | Comparative toner 10 | Comparative toner 11 | Comparative toner 12 | Comparative toner 13 | Comparative toner 14 |
| Physical properties | THF insoluble content (%) | 15.4 | 14.2 | 12.6 | 9.8 | 10.4 | 8.9 | 9.2 |
| | Average circularity | 0.978 | 0.981 | 0.982 | 0.984 | 0.982 | 0.973 | 0.971 |
| | Mode circularity | 1.00 | 1.00 | 1.00 | 1.00 | 1.00 | 1.00 | 1.00 |
| | Weight-average molecular weight | 34500 | 34200 | 34100 | 34300 | 34500 | 25200 | 41500 |
| | Weight-average molecular weight/ Number-average molecular weight | 11.4 | 10.8 | 11.4 | 12.3 | 11.4 | 17.5 | 18.8 |
| | Equivalent circle diameter determined from cross section of toner particle Dtemav. (μm) | 5.6 | 5.6 | 5.7 | 5.6 | 5.6 | 5.6 | 5.7 |
| | Weight-average particle size (μm) | 5.7 | 5.6 | 5.6 | 5.6 | 5.6 | 5.6 | 5.6 |
| | Number-average particle size (μm) | 5.2 | 5.3 | 8.4 | 5.8 | 7 | 5.3 | 5.3 |

TABLE 6-continued

| | | | | | | | |
|---|---|---|---|---|---|---|---|
| Endothermic main peak temperature (° C.) | 70.6 | 70.1 | 70.3 | 70.3 | 70.8 | 70.6 | 70.3 |
| Integrated calorific value (J/g) | 19.2 | 19.4 | 19.1 | 19.1 | 19.6 | 19.3 | 1.9 |
| Glass transition temperature (° C.) | 50.1 | 50.3 | 50.6 | 50.7 | 50.9 | 50.1 | 50.3 |
| 80° C. viscosity (Pa · S) | 19200 | 19400 | 19300 | 19800 | 19100 | 18500 | 17900 |
| Shape factor SF-2 | 128 | 126 | 118 | 119 | 120 | 118 | 121 |

TABLE 7

| | Toner particles | | | | | |
|---|---|---|---|---|---|---|
| | Toner particles 1 | Toner particles 2 | Toner particles 3 | Toner particles 4 | Toner particles 5 | Toner particles 6 |
| Organic silicon compound R2, R3, and R4 in formula (Z) | Vinyltriethoxy-silane Ethoxy group | Allyltriethoxy-silane Ethoxy group | Vinyltriethoxy-silane Ethoxy group | Vinyltriethoxy-silane Ethoxy group | Vinyltriethoxy-silane Ethoxy group | Vinyltriethoxy-silane Methoxy group |
| Average thickness of surface layer Dav. (nm) | 15.5 | 10.8 | 15.2 | 15.3 | 15.0 | 15.1 |
| Number of non-adjacent line segments having a length equal to or smaller than RAav × 0.90 | 2 | 2 | 2 | 2 | 2 | 2 |
| Si concentration at toner particle surface measured by ESCA (atomic %) | 15.2 | 13.2 | 13.5 | 13.8 | 13.6 | 13.5 |
| Percentage of surface layer thicknesses that are 5.0 nm or less | 12.5 | 20.4 | 15.0 | 15.2 | 15.2 | 15 |
| Production method | First method | First method | First method | First method | First method | First method |
| Absence or presence of methine group bonded to silicon atom in formula (1) (>CH—Si) | Present | Absent | Present | Present | Present | Present |
| Absence or presence of methylene group bonded to silicon atom in formula (2) (—$CH_2$—Si) | Absent | Present | Absent | Absent | Absent | Absent |

| | Toner particles | | | | | |
|---|---|---|---|---|---|---|
| | Toner particles 7 | Toner particles 8 | Toner particles 9 | Toner particles 10 | Toner particles 11 | Toner particles 12 |
| Organic silicon compound R2, R3, and R4 in formula (Z) | Vinyltriethoxy-silane Isopropoxy group | Vinyltriethoxy-silane Chloro group, ethoxy group | Vinyltriethoxy-silane Ethoxy group | Vinyltriethoxy-silane Ethoxy group | Vinyltriethoxy-silane Ethoxy group | Vinyltriethoxy-silane Ethoxy group |
| Average thickness of surface layer Dav. (nm) | 15.3 | 14.8 | 44.9 | 25.2 | 10.2 | 8.5 |
| Number of non-adjacent line segments having a length equal to or smaller than RAav × 0.90 | 3 | 2 | 3 | 3 | 2 | 2 |
| Si concentration at toner particle surface measured by ESCA (atomic %) | 13.8 | 12.7 | 20.2 | 18.5 | 14.6 | 13.2 |
| Percentage of surface layer thicknesses that are 5.0 nm or less | 15.2 | 21.5 | 3.1 | 7.8 | 18.8 | 25 |

TABLE 7-continued

| | | | | | | |
|---|---|---|---|---|---|---|
| Production method | First method | First method | First method | First method | First method | First method |
| Absence or presence of methine group bonded to silicon atom in formula (1) (>CH—Si) | Present | Present | Present | Present | Present | Present |
| Absence or presence of methylene group bonded to silicon atom in formula (2) (—$CH_2$—Si) | Absent | Absent | Absent | Absent | Absent | Absent |

"First method" means the first production method described in the specification.

TABLE 8

| | Toner particles | | | | | |
|---|---|---|---|---|---|---|
| | Toner particles 13 | Toner particles 14 | Toner particles 15 | Toner particles 16 | Toner particles 17 | Toner particles 18 |
| Organic silicon compound R2, R3, and R4 in formula (Z) | Vinyltriethoxy-silane Ethoxy group | Vinyltriethoxy-silane Ethoxy group | Allyltriethoxy-silane Ethoxy group | Allyltriethoxy-silane Ethoxy group | Vinyltriethoxy-silane Ethoxy group | Allyltriethoxy-silane Ethoxy group |
| Average thickness of surface layer Dav. (nm) | 6.9 | 5.2 | 10.0 | 7.9 | 14.8 | 14.7 |
| Number of non-adjacent line segments having a length equal to or smaller than RAav × 0.90 | 2 | 1 | 2 | 1 | 2 | 2 |
| Si concentration at toner particle surface measured by ESCA (atomic %) | 10.2 | 5.2 | 12.1 | 11.5 | 12.3 | 12.6 |
| Percentage of surface layer thicknesses that are 5.0 nm or less | 27.2 | 29.8 | 21.5 | 23.8 | 21.9 | 0 |
| Production method | First method | First method | First method | First method | Second method | Third method |
| Absence or presence of methine group bonded to silicon atom in formula (1) (>CH—Si) | Present | Present | Present | Present | Present | Absent |
| Absence or presence of methylene group bonded to silicon atom in formula (2) (—$CH_2$—Si) | Absent | Absent | Absent | Absent | Absent | Present |

| | Toner particles | | | | | |
|---|---|---|---|---|---|---|
| | Toner particles 19 | Toner particles 20 | Toner particles 21 | Toner particles 22 | Toner particles 23 | Toner particles 24 |
| Organic silicon compound R2, R3, and R4 in formula (Z) | Vinyltriethoxy-silane Ethoxy group | Vinyltriethoxy-silane Ethoxy group | Vinyltriethoxy-silane Ethoxy group | Vinyltriethoxy-silane Ethoxy group | Vinyltriethoxy-silane Ethoxy group | Vinyltriethoxy-silane Ethoxy group |
| Average thickness of surface layer Dav. (nm) | 15.1 | 14.4 | 15.8 | 15.2 | 15.3 | 15.4 |
| Number of non-adjacent line segments having a length equal to or smaller than RAav × 0.90 | 2 | 2 | 2 | 2 | 2 | 2 |
| Si concentration at toner particle surface measured by ESCA (atomic %) | 12.9 | 12.8 | 15.1 | 15.5 | 15.3 | 15.1 |
| Percentage of surface layer thicknesses that are 5.0 nm or less | 0 | 28.1 | 12.1 | 12.2 | 12.5 | 12 |

TABLE 8-continued

| | | | | | | |
|---|---|---|---|---|---|---|
| Production method | Fourth method | Fifth method | First method | First method | First method | First method |
| Absence or presence of methine group bonded to silicon atom in formula (1) (>CH—Si) | Present | Present | Present | Present | Present | Present |
| Absence or presence of methylene group bonded to silicon atom in formula (2) (—$CH_2$—Si) | Absent | Absent | Absent | Absent | Absent | Absent |

"First method" means the first production method described in the specification.

"Second method" means the second production method described in the specification.

"Third method" means the third production method described in the specification.

"Fourth method" means the fourth production method described in the specification.

"Fifth method" means the fifth production method described in the specification.

TABLE 9

| | Toner particles | | | | | | |
|---|---|---|---|---|---|---|---|
| | Comparative toner particles 1 | Comparative toner particles 2 | Comparative toner particles 3 | Comparative toner particles 4 | Comparative toner particles 5 | Comparative toner particles 6 | Comparative toner particles 7 |
| Organic silicon compound | Vinyltriethoxy-silane | Allyltriethoxy-silane | None | 3-Methacryloxy-propyl-triethoxysilane | 3-Methacryloxy-propyl-triethoxysilane | 3-Methacryloxy-propyl-triethoxysilane | 3-Methacryloxy-propyl-triethoxysilane |
| R2, R3, and R4 in formula (Z) | Ethoxy group | Ethoxy group | Ethoxy group | Ethoxy group | Ethoxy group | Ethoxy group | Ethoxy group |
| Average thickness of surface layer Dav. (nm) | 4.2 | 4 | 14 | 3.5 | 2.4 | 3.7 | 2.2 |
| Number of non-adjacent line segments having a length equal to or smaller than RAav × 0.90 | 1 | 0 | 0 | 0 | 0 | 0 | 0 |
| Si concentration at toner particle surface measured by ESCA (atomic %) | 4.2 | 2.3 | 25.4 | 8.7 | 4.2 | 8.2 | 3.8 |
| Percentage of surface layer thicknesses that are 5.0 nm or less | 77.5 | 88.7 | 50 | 94.4 | 100 | 97.2 | 100 |
| Production method | First method | First method | First method | First method | First method | First method | First method |
| Absence or presence of methine group bonded to silicon atom in formula (1) (>CH—Si) | Present | Absent | Absent | Absent | Absent | Absent | Absent |
| Absence or presence of methylene group bonded to silicon atom in formula (2) (—$CH_2$—Si) | Absent | Present | Absent | Absent | Absent | Absent | Absent |

| | Toner particles | | | | | | |
|---|---|---|---|---|---|---|---|
| | Comparative toner particles 8 | Comparative toner particles 9 | Comparative toner particles 10 | Comparative toner particles 11 | Comparative toner particles 12 | Comparative toner particles 13 | Comparative toner particles 14 |
| Organic silicon compound | Allyltriethoxy-silane | Allyltriethoxy-silane | Aminopropyl-trimethoxysilane | — | Methyltriethoxy-silane | — | — |
| R2, R3, and R4 in formula (Z) | Ethoxy group | Ethoxy group | Methoxy group | — | Ethoxy group | — | — |

TABLE 9-continued

| | | | | | | | |
|---|---|---|---|---|---|---|---|
| Average thickness of surface layer Dav. (nm) | 4 | 3.9 | 24 | 0 | 2.4 | 0 | 0 |
| Number of non-adjacent line segments having a length equal to or smaller than RAav × 0.90 | 0 | 0 | 0 | 0 | 0 | 0 | 0 |
| Si concentration at toner particle surface measured by ESCA (atomic %) | 3.8 | 2.1 | 0 | 0 | 2.6 | 0 | 0 |
| Percentage of surface layer thicknesses that are 5.0 nm or less | 78.1 | 93.8 | 0 | 0 | 96.8 | 0 | 0 |
| Production method | First method | First method | First method | First method | First method | Third method | Fourth method |
| Absence or presence of methine group bonded to silicon atom in formula (1) (>CH—Si) | Absent | Absent | Absent | Absent | Absent | Absent | Absent |
| Absence or presence of methylene group bonded to silicon atom in formula (2) (—$CH_2$—Si) | Present | Present | Absent | Absent | Absent | Absent | Absent |

"First method" means the first production method described in the specification.
"Third method" means the third production method described in the specification.
"Fourth method" means the fourth production method described in the specification.

TABLE 10

| | | | | Ex. 1 Toner 1 | Ex. 2 Toner 2 | Ex. 3 Toner 3 | Ex. 4 Toner 4 | Ex. 5 Toner 5 | Ex. 6 Toner 6 |
|---|---|---|---|---|---|---|---|---|---|
| Storage stability | | | Storage property (55° C./15 days) | A | B | A | A | B | A |
| | | | Long-term storage property (45° C./95% three months) | A | B | A | B | C | A |
| Environmental stability and development durability | NN | Initial | Triboelectric charge amount (μC/g) | −40.1 | −40.4 | −40.2 | −40.3 | −40.3 | −40.2 |
| | | | Fogging | 0.3(A) | 0.3(A) | 0.3(A) | 0.3(A) | 0.2(A) | 0.2(A) |
| | | | Density | 1.51(A) | 1.49(A) | 1.52(A) | 1.51(A) | 1.50(A) | 1.49(A) |
| | | After 20,000 outputs | Fogging | 0.4(A) | 0.7(A) | 0.5(A) | 0.3(A) | 0.3(A) | 0.3(A) |
| | | | Density | 1.5(A) | 1.48(A) | 1.50(A) | 1.50(A) | 1.48(A) | 1.49(A) |
| | | | Soiling of parts | A | A | A | A | A | A |
| | | | Cleaning performance | A | A | A | A | A | A |
| | | | Cleaning performance at 0° C. | A | A | A | A | A | A |
| | LL | Initial | Triboelectric charge amount (μC/g) | −43.4 | −44.2 | −43.3 | −43.1 | −41.2 | −43.1 |
| | | | Fogging | 0.4(A) | 0.6(A) | 0.3(A) | 0.3(A) | 0.3(A) | 0.3(A) |
| | | | Density | 1.51(A) | 1.48(A) | 1.48(A) | 1.48(A) | 1.48(A) | 1.48(A) |
| | | After 20,000 outputs | Fogging | 0.4(A) | 0.7(A) | 0.3(A) | 0.3(A) | 0.6(A) | 0.3(A) |
| | | | Density | 1.51(A) | 1.47(A) | 1.48(A) | 1.48(A) | 1.48(A) | 1.48(A) |
| | | | Soiling of parts | A | A | A | A | A | A |
| | | | Cleaning performance | A | A | A | A | A | A |
| | | | Cleaning performance at 0° C. | A | A | A | A | A | A |
| | SHH | Initial | Triboelectric charge amount (μC/g) | −37.6 | −37.4 | −37.4 | −38.7 | −38.6 | −39.1 |
| | | | Fogging | 0.7(A) | 0.9(A) | 0.2(A) | 0.5(A) | 0.6(A) | 0.5(A) |
| | | | Density | 1.5(A) | 1.47(A) | 1.47(A) | 1.46(A) | 1.50(A) | 1.48(A) |
| | | After 20,000 outputs | Fogging | 0.7(A) | 0.9(A) | 0.6(A) | 0.9(A) | 0.3(A) | 0.5(A) |
| | | | Density | 1.49(A) | 1.50(A) | 1.50(A) | 1.48(A) | 1.39(C) | 1.47(A) |
| | | | Soiling of parts | A | A | A | A | A | A |
| | | | Cleaning performance | A | A | A | A | A | A |
| | | | Cleaning performance at 0° C. | A | A | A | A | A | A |
| Low-temperature fixability | Low-temperature offset end temperature (° C.) | | | 115 | 115 | 115 | 115 | 115 | 115 |

TABLE 10-continued

| | | | | Ex. 7 Toner 7 | Ex. 8 Toner 8 | Ex. 9 Toner 9 | Ex. 10 Toner 10 | Ex. 11 Toner 11 | Ex. 12 Toner 12 |
|---|---|---|---|---|---|---|---|---|---|
| Storage stability | | | Storage property (55° C./15 days) | A | A | A | A | A | A |
| | | | Long-term storage property (45° C./95% three months) | A | A | A | A | A | A |
| Environmental stability and development durability | NN | Initial | Triboelectric charge amount (μC/g) | −40.1 | −40 | −42.8 | −41.2 | −40.1 | −39.8 |
| | | | Fogging | 0.2(A) | 0.2(A) | 0.2(A) | 0.2(A) | 0.5(A) | 0.6(A) |
| | | | Density | 1.5(A) | 1.49(A) | 1.5(A) | 1.5(A) | 1.48(A) | 1.48(A) |
| | | After 20,000 outputs | Fogging | 0.4(A) | 0.3(A) | 0.3(A) | 0.3(A) | 0.7(A) | 0.8(A) |
| | | | Density | 1.5(A) | 1.49(A) | 1.5(A) | 1.5(A) | 1.48(A) | 1.48(A) |
| | | | Soiling of parts | A | A | A | A | A | A |
| | | | Cleaning performance | A | A | A | A | A | A |
| | | | Cleaning performance at 0° C. | A | A | A | A | A | A |
| | LL | Initial | Triboelectric charge amount (μC/g) | −42.7 | −42.5 | −43.3 | −43.1 | −41.2 | −40.5 |
| | | | Fogging | 0.4(A) | 0.3(A) | 0.3(A) | 0.3(A) | 0.3(A) | 0.6(A) |
| | | | Density | 1.48(A) | 1.48(A) | 1.48(A) | 1.48(A) | 1.48(A) | 1.47(A) |
| | | After 20,000 outputs | Fogging | 0.4(A) | 0.3(A) | 0.3(A) | 0.3(A) | 0.3(A) | 0.6(A) |
| | | | Density | 1.48(A) | 1.48(A) | 1.48(A) | 1.48(A) | 1.48(A) | 1.47(A) |
| | | | Soiling of parts | A | A | A | A | A | B |
| | | | Cleaning performance | A | A | A | A | A | A |
| | | | Cleaning performance at 0° C. | A | A | A | A | A | B |
| | SHH | Initial | Triboelectric charge amount (μC/g) | −38.7 | −38.6 | −41.8 | −40.5 | −39.8 | −39.5 |
| | | | Fogging | 0.5(A) | 0.6(A) | 0.2(A) | 0.2(A) | 0.5(A) | 0.6(A) |
| | | | Density | 1.47(A) | 1.46(A) | 1.5(A) | 1.5(A) | 1.48(A) | 1.48(A) |
| | | After 20,000 outputs | Fogging | 0.6(A) | 0.9(A) | 0.3(A) | 0.3(A) | 0.7(A) | 0.8(A) |
| | | | Density | 1.45(A) | 1.45(A) | 1.5(A) | 1.5(A) | 1.48(A) | 1.48(A) |
| | | | Soiling of parts | A | A | A | A | A | A |
| | | | Cleaning performance | A | A | A | A | A | A |
| | | | Cleaning performance at 0° C. | A | A | A | A | A | A |
| Low-temperature fixability | Low-temperature offset end temperature (° C.) | | | 115 | 115 | 135 | 130 | 115 | 115 |

TABLE 11

| | | | | Ex. 13 Toner 13 | Ex. 14 Toner 14 | Ex. 15 Toner 15 | Ex. 16 Toner 16 | Ex. 17 Toner 17 | Ex. 18 Toner 18 |
|---|---|---|---|---|---|---|---|---|---|
| Storage stability | | | Storage property (55° C./15 days) | A | B | A | B | A | A |
| | | | Long-term storage property (45° C./95% three months) | B | C | B | C | A | A |
| Environmental stability and development durability | NN | Initial | Triboelectric charge amount (μC/g) | −39.5 | −38.8 | −39.4 | −39 | −40 | −40.1 |
| | | | Fogging | 0.6(A) | 0.7(A) | 0.5(A) | 0.5(A) | 0.2(A) | 0.5(A) |
| | | | Density | 1.47(A) | 1.47(A) | 1.48(A) | 1.46(A) | 1.49(A) | 1.48(A) |
| | | After 20,000 outputs | Fogging | 0.7(A) | 0.8(A) | 0.6(A) | 1.0(B) | 0.3(A) | 0.7(A) |
| | | | Density | 1.46(A) | 1.46(A) | 1.48(A) | 1.45(A) | 1.49(A) | 1.48(A) |
| | | | Soiling of parts | A | A | A | A | A | A |
| | | | Cleaning performance | A | A | A | A | A | A |
| | | | Cleaning performance at 0° C. | A | B | A | B | B | B |
| | LL | Initial | Triboelectric charge amount (μC/g) | −40.1 | −39.6 | −39.9 | −39.8 | −42.5 | −41.2 |
| | | | Fogging | 0.6(A) | 0.7(A) | 0.6(A) | 0.9(A) | 0.3(A) | 0.3(A) |
| | | | Density | 1.45(A) | 1.44(B) | 1.44(B) | 1.42(B) | 1.48(A) | 1.48(A) |
| | | After 20,000 outputs | Fogging | 0.6(A) | 0.8(A) | 0.6(A) | 1.0(B) | 0.3(A) | 0.3(A) |
| | | | Density | 1.44(B) | 1.42(B) | 1.44(B) | 1.41(B) | 1.48(A) | 1.48(A) |
| | | | Soiling of parts | B | A | A | B | B | B |
| | | | Cleaning performance | A | B | B | B | B | B |
| | | | Cleaning performance at 0° C. | B | B | B | C | C | B |
| | SHH | Initial | Triboelectric charge amount (μC/g) | −39 | −38.4 | −38.9 | −38.2 | −38.6 | −39.8 |
| | | | Fogging | 1.0(B) | 1.2(B) | 1.2(B) | 1.3(B) | 0.9(A) | 0.7(A) |
| | | | Density | 1.44(B) | 1.42(B) | 1.43(B) | 1.41(B) | 1.46(A) | 1.48(A) |
| | | After 20,000 outputs | Fogging | 1.2(B) | 1.6(C) | 1.4(B) | 1.6(C) | 1.0(B) | 1.2(B) |
| | | | Density | 1.4(B) | 1.39(C) | 1.4(B) | 1.39(C) | 1.45(A) | 1.48(A) |
| | | | Soiling of parts | A | B | B | B | B | B |
| | | | Cleaning performance | B | B | B | B | B | B |
| | | | Cleaning performance at 0° C. | B | B | B | B | C | B |
| Low-temperature fixability | Low-temperature offset end temperature (° C.) | | | 115 | 115 | 115 | 115 | 115 | 115 |

TABLE 11-continued

| | | | | Ex. 19 Toner 19 | Ex. 20 Toner 20 | Ex. 21 Toner 21 | Ex. 22 Toner 22 | Ex. 23 Toner 23 | Ex. 24 Toner 24 |
|---|---|---|---|---|---|---|---|---|---|
| Storage stability | | | Storage property (55° C./15 days) | A | A | A | A | A | A |
| | | | Long-term storage property (45° C./95% three months) | A | A | A | A | A | A |
| Environmental stability and development durability | NN | Initial | Triboelectric charge amount (μC/g) | −39.8 | −40.4 | −40.0 | −41.3 | −38.8 | −40.3 |
| | | | Fogging | 0.6(A) | 0.3(A) | 0.4(A) | 0.2(A) | 0.4(A) | 0.3(A) |
| | | | Density | 1.48(A) | 1.49(A) | 1.51(A) | 1.51(A) | 1.51(A) | 1.50(A) |
| | | After 20,000 outputs | Fogging | 0.8(A) | 0.7(A) | 0.3(A) | 0.3(A) | 0.6(A) | 0.4(A) |
| | | | Density | 1.48(A) | 1.48(A) | 1.50(A) | 1.50(A) | 1.50(A) | 1.49(A) |
| | | | Soiling of parts | A | A | A | A | A | A |
| | | | Cleaning performance | A | A | A | A | A | A |
| | | | Cleaning performance at 0° C. | B | B | A | A | A | A |
| | LL | Initial | Triboelectric charge amount (μC/g) | −40.5 | −44.2 | −43.5 | −44.5 | −40.8 | −43.1 |
| | | | Fogging | 0.6(A) | 0.6(A) | 0.5(A) | 0.2(A) | 0.4(A) | 0.3(A) |
| | | | Density | 1.47(A) | 1.48(A) | 1.51(A) | 1.50(A) | 1.50(A) | 1.50(A) |
| | | After 20,000 outputs | Fogging | 0.6(A) | 0.7(A) | 0.4(A) | 0.3(A) | 0.5(A) | 0.3(A) |
| | | | Density | 1.47(A) | 1.47(A) | 1.50(A) | 1.49(A) | 1.50(A) | 1.49(A) |
| | | | Soiling of parts | B | B | A | A | A | A |
| | | | Cleaning performance | B | B | A | A | A | A |
| | | | Cleaning performance at 0° C. | C | C | A | A | A | A |
| | SHH | Initial | Triboelectric charge amount (μC/g) | −39.5 | −37.4 | −37.8 | −38.9 | −35.9 | −37.1 |
| | | | Fogging | 0.8(A) | 0.9(A) | 0.7(A) | 0.6(A) | 0.9(A) | 0.7(A) |
| | | | Density | 1.48(A) | 1.47(A) | 1.50(A) | 1.50(A) | 1.50(A) | 1.50(A) |
| | | After 20,000 outputs | Fogging | 1.2(B) | 1.3(B) | 0.7(A) | 0.7(A) | 1.0(B) | 0.8(A) |
| | | | Density | 1.48(A) | 1.46(A) | 1.50(A) | 1.49(A) | 1.49(A) | 1.49(A) |
| | | | Soiling of parts | B | B | A | A | A | A |
| | | | Cleaning performance | B | B | A | A | A | A |
| | | | Cleaning performance at 0° C. | C | C | A | A | A | A |
| Low-temperature fixability | Low-temperature offset end temperature (° C.) | | | 115 | 115 | 110 | 115 | 115 | 115 |

TABLE 12

| | | | | C. Ex. 1 | C. Ex. 2 | C. Ex. 3 | C. Ex. 4 | C. Ex. 5 | C. Ex. 6 | C. Ex. 7 | C. Ex. 8 | C. Ex. 9 | C. Ex. 10 | C. Ex. 11 | C. Ex. 12 | C. Ex. 13 | C. Ex. 14 |
|---|---|---|---|---|---|---|---|---|---|---|---|---|---|---|---|---|---|
| | | | | Comparative toner 1 | Comparative toner 2 | Comparative toner 3 | Comparative toner 4 | Comparative toner 5 | Comparative toner 6 | Comparative toner 7 | Comparative toner 8 | Comparative toner 9 | Comparative toner 10 | Comparative toner 11 | Comparative toner 12 | Comparative toner 13 | Comparative toner 14 |
| Storage stability | | | Storage property (55° C./15 days) | C | C | D | C | C | B | C | C | C | C | E | B | E | E |
| | | | Long-term storage property (45° C./95% three months) | E | E | E | D | D | D | E | E | E | C | E | E | E | E |
| Environmental stability and development durability | NN | Initial | Triboelectric charge amount (μC/g) | −38.2 | −38 | −45.2 | −39.2 | −38.2 | −41.2 | −41.6 | −38.2 | −38 | −8.2 | −32.1 | −38 | 30.5 | 29.9 |
| | | | Fogging | 0.3(A) | 0.4(A) | 0.8(A) | 0.5(A) | 0.9(A) | 0.3(A) | 1.1(B) | 0.3(A) | 0.4(A) | 6.38(F) | 3.8(F) | 0.2(A) | 4.8(F) | 5.5(F) |
| | | | Density | 1.42(B) | 1.41(B) | 1.38(C) | 1.4(B) | 1.38(C) | 1.42(B) | 1.41(B) | 1.42(B) | 1.41(B) | 0.89(F) | 0.67(F) | 1.41(B) | 0.71(F) | 0.72(F) |
| | | After 20,000 outputs | Fogging | 0.7(A) | 0.8(A) | 1.2(B) | 0.8(A) | 1.2(B) | 0.6(A) | 1.5(C) | 0.7(A) | 0.8(A) | 6.4(F) | 4.3(F) | 0.6(A) | 5.8(F) | 6.2(F) |
| | | | Density | 1.38(C) | 1.37(C) | 1.34(C) | 1.37(C) | 1.35(C) | 1.39(C) | 1.37(C) | 1.38(C) | 1.37(C) | 0.87(F) | 0.62(F) | 1.37(C) | 0.68(F) | 0.69(F) |
| | | | Soiling of parts | C | C | C | C | C | C | C | C | C | E | E | C | E | E |
| | | | Cleaning performance | B | B | B | B | B | B | B | B | B | C | E | B | E | E |
| | | | Cleaning performance at 0° C. | C | D | D | D | D | D | D | D | D | E | E | C | E | E |
| | LL | Initial | Triboelectric charge amount (μC/g) | −50.1 | −50.5 | −52.1 | −41.9 | −43.5 | −42.5 | −45.4 | −50.1 | −50.5 | −10.4 | −36.4 | −49.6 | 34.1 | 33.6 |
| | | | Fogging | 1.1(B) | 1.5(C) | 1.6(C) | 0.9(A) | 1.6(C) | 0.7(A) | 1.7(C) | 1.1(B) | 1.5(C) | 7.4(F) | 6.5(F) | 1.0(B) | 5.2(F) | 5.9(F) |
| | | | Density | 1.4(B) | 1.39(C) | 1.38(C) | 1.38(C) | 1.34(C) | 1.4(B) | 1.42(B) | 1.4(B) | 1.39(C) | 0.72(F) | 0.54(F) | 1.41(B) | 0.72(F) | 0.7(F) |
| | | After 20,000 outputs | Fogging | 1.3(B) | 1.7(C) | 1.9(C) | 1.1(B) | 1.8(C) | 0.8(A) | 1.9(C) | 1.3(B) | 1.7(C) | 7.42(F) | 7.0(F) | 1.2(B) | 6.2(F) | 6.6(F) |
| | | | Density | 1.38(C) | 1.37(C) | 1.35(C) | 1.36(C) | 1.32(C) | 1.39(C) | 1.4(B) | 1.38(C) | 1.37(C) | 0.7(F) | 0.49(F) | 1.39(C) | 0.61(F) | 0.62(F) |
| | | | Soiling of parts | C | D | D | D | D | D | D | D | D | E | E | D | E | E |
| | | | Cleaning performance | B | C | B | B | C | C | C | C | C | C | E | B | E | E |
| | | | Cleaning performance at 0° C. | D | E | D | D | E | E | E | E | E | E | E | D | E | E |
| | SHH | Initial | Triboelectric charge amount (μC/g) | −31.2 | −30.2 | −29.4 | −31.6 | −30.4 | −36.2 | −31.4 | −31.2 | −30.2 | −6.1 | −26.4 | −30.6 | 27.2 | 26.9 |
| | | | Fogging | 1.4(B) | 2.0(D) | 2.1(D) | 1.6(C) | 1.8(C) | 0.8(A) | 2.1(D) | 1.4(B) | 2.0(D) | 8.2(F) | 8.6(F) | 1.3(B) | 6.2(F) | 6.5(F) |
| | | | Density | 1.34(C) | 1.32(C) | 1.29(C) | 1.34(C) | 1.32(C) | 1.37(C) | 1.24(E) | 1.34(C) | 1.32(C) | 0.66(F) | 0.55(F) | 1.32(C) | 0.69(F) | 0.69(F) |
| | | After 20,000 outputs | Fogging | 1.6(C) | 2.2(D) | 2.4(D) | 1.8(C) | 2.0(D) | 0.9(A) | 2.3(D) | 1.6(C) | 2.2(D) | 8.22(F) | 9.1(F) | 1.5(C) | 7.9(F) | 8.1(F) |
| | | | Density | 1.32(C) | 1.3(C) | 1.26(D) | 1.32(C) | 1.3(C) | 1.36(C) | 1.22(E) | 1.32(C) | 1.3(C) | 0.64(F) | 0.5(F) | 1.3(C) | 0.66(F) | 0.67(F) |
| | | | Soiling of parts | C | D | D | D | D | D | E | D | D | E | E | D | E | E |
| | | | Cleaning performance | B | C | B | B | B | B | C | B | C | C | E | B | E | E |
| | | | Cleaning performance at 0° C. | E | E | E | E | E | E | E | E | E | E | E | E | E | E |
| Low-temperature fixability | Low-temperature offset end temperature (° C.) | | | 115 | 115 | 115 | 115 | 115 | 115 | 115 | 115 | 115 | 115 | 115 | 115 | 115 | 115 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-288237 filed Dec. 28, 2012, which is hereby incorporated by reference herein in its entirety.

What is claimed is:

1. A toner comprising:

toner particles each including a surface layer that contains an organic silicon polymer, the organic silicon polymer including a unit represented by formula (1) or (2) below:

(1)

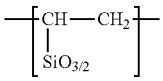

(2)

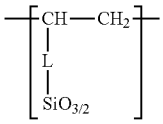

(In formula (2), L represents a methylene group, an ethylene group, or a phenylene group), wherein, an average thickness Dav. of the surface layers measured by observation of cross sections of the toner particles with a transmission electron microscope is 5.0 nm or more and 150.0 nm or less, a silicon concentration determined by electron spectroscopy for chemical analysis performed on surfaces of the toner particles is 2.5 atomic % or more, the toner has a shape factor SF-2 of 140 or more and 260 or less, and the toner has an average circularity of 0.970 or more and 0.990 or less.

2. The toner according to claim 1, wherein:

in an observation of a cross section of the toner particle with a transmission electron microscope, 16 straight lines extending across the cross section are drawn so that all the straight lines intersect at a midpoint of a long axis L, which is a maximum diameter of the cross section, and all the intersectional angles are even, i.e. all the intersectional angles are 11.25°, the resultant 32 line segments extending from the midpoint to the outer periphery of the cross section, have respective lengths, and among the 32 line segments, at least two of them not adjacent to each other have lengths which are 0.90 times RAav or less, where RAav is an arithmetic average value of the 32 line segments' lengths.

3. The toner according to claim 1, wherein:

among the toner particles, regarding the toner particles whose equivalent circle diameters are within the ±10% range of a weight-average particle diameter of the toner, an existing ratio of a portion(s) where the surface layer thickness is 5.0 nm or less is 20.0% or less, wherein, the existing ratio is determined by the following process (i) observing 10 toner particles whose equivalent circle diameters are within the ±10% range of a weight-average particle diameter of the toner with a transmission electron microscope, (ii) on each of the cross sections drawing 16 straight lines extending across the cross section so that all the straight lines intersect at a midpoint of a long axis L, which is a maximum diameter of the cross section, and all the intersectional angles are even, i.e. all the intersectional angles are 11.25°, (iii) on the resultant 32 line segments extending from the midpoint to the outer periphery of the cross section, measuring lengths by which the respective line segments overlap with the surface layer, and counting the number of line segment(s) of which the length(s) is/are 5.0 nm or less, (iv) dividing the resultant number of line segments by 32 and then multiplying the result by 100 to obtain a percentage value, (v) deriving arithmetic average value by using the respective percentage values of the respective 10 toner particles to obtain the existing ratio.

4. The toner according to claim 1, wherein the organic silicon polymer is obtained by polymerizing a polymerizable monomer that contains a compound represented by formula (Z) below:

(Z)

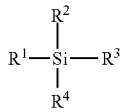

(In formula (Z), $R^1$ represents (i) $CH_2{=}CH{-}$ or (ii) $CH_2{=}CH\text{-}L\text{-}$ (in formula (ii), L represents a methylene group, an ethylene group, or a phenylene group) and $R^2$, $R^3$, and $R^4$ each independently represent a halogen atom, a hydroxy group, or an alkoxy group.)

5. The toner according to claim 4, wherein $R^1$ in formula (Z) represents a vinyl group or an allyl group.

6. The toner according to claim 4, wherein $R^2$, $R^3$, and $R^4$ in formula (Z) each independently represent an alkoxy group.

7. The toner according to claim 3, wherein the toner particles are produced by forming particles in an aqueous medium from a polymerizable monomer composition that contains a colorant and the polymerizable monomer, and polymerizing the polymerizable monomer.

* * * * *